US011547270B2

(12) United States Patent
Kessler et al.

(10) Patent No.: US 11,547,270 B2
(45) Date of Patent: Jan. 10, 2023

(54) MONITORING OF LOADING AND/OR UNLOADING OF DISHWASHER MACHINES

(71) Applicant: Henkel AG & Co. KGaA, Duesseldorf (DE)

(72) Inventors: Arnd Kessler, Monheim am Rhein (DE); Lars Zuechner, Langenfeld (DE); Robert Ruiz Hernandez, Duesseldorf (DE); Thomas Juckel, Monheim (DE); Wolfgang Wick, Dormagen (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 87 days.

(21) Appl. No.: 16/767,548

(22) PCT Filed: Jun. 26, 2019

(86) PCT No.: PCT/EP2019/066947
§ 371 (c)(1),
(2) Date: May 27, 2020

(87) PCT Pub. No.: WO2020/002395
PCT Pub. Date: Jan. 2, 2020

(65) Prior Publication Data

US 2021/0169304 A1 Jun. 10, 2021

(30) Foreign Application Priority Data

Jun. 27, 2018 (DE) ..... 10 2018 210 497.2

(51) Int. Cl.
*A47L 15/42* (2006.01)
*A47L 15/44* (2006.01)
(Continued)

(52) U.S. Cl.
CPC ..... *A47L 15/46* (2013.01); *A47L 15/4295* (2013.01); *A47L 15/44* (2013.01); *A47L 15/449* (2013.01); *A47L 15/50* (2013.01)

(58) Field of Classification Search
None
See application file for complete search history.

(56) References Cited

U.S. PATENT DOCUMENTS 8,382,304 B2 2/2013 Wegener et al.

FOREIGN PATENT DOCUMENTS

DE 10048085 A1 4/2002
DE 102016213232 A1 1/2018
(Continued)

OTHER PUBLICATIONS

EPO, International Search Report issued in International Application No. PCT/EP2019/066947, dated Aug. 16, 2019.

*Primary Examiner* — Levon J Shahinian
(74) *Attorney, Agent, or Firm* — Lorenz & Kopf, LLP

(57) ABSTRACT

Among other things, a method is disclosed which comprises the following: acquiring at least one set of acceleration data indicative of a progression of measured acceleration values; determining at least one set of evaluation data at least partially based on the acquired acceleration data, wherein determining the evaluation data comprises determining whether one or more characteristic actions have been performed by a user, and if so, performing the following: storing an action data representing the one or more actions that is included in the determined evaluation data or is at least a part of the determined evaluation data; and outputting or causing the output of the determined evaluation data. A device for executing and/or controlling this method, a system with one or more devices for executing and/or controlling this method and a computer program for executing
(Continued)

and/or controlling this method by a processor are further disclosed.

20 Claims, 11 Drawing Sheets

(51) Int. Cl.
*A47L 15/46* (2006.01)
*A47L 15/50* (2006.01)

(56) References Cited

FOREIGN PATENT DOCUMENTS

| | | | |
|---|---|---|---|
| EP | 0793939 | A1 | 9/1997 |
| EP | 1192892 | A1 | 4/2002 |
| EP | 2662014 | A1 | 11/2013 |
| JP | 2018094416 | A1 | 6/2018 |
| WO | 2018110287 | A1 | 6/2018 |

MONITORING OF LOADING AND/OR UNLOADING OF DISHWASHER MACHINES

CROSS-REFERENCE TO RELATED APPLICATION

This application is a U.S. National-Stage entry under 35 U.S.C. § 371 based on International Application No. PCT/EP2019/066947, filed Jun. 26, 2019, which was published under PCT Article 21(2) and which claims priority to German Application No. 10 2018 210 497.2, filed Jun. 27, 2018, which are all hereby incorporated in their entirety by reference.

TECHNICAL FIELD

Exemplary embodiments concern a method for a dishwasher and a device for use inside a dishwasher, particularly for monitoring loading and/or unloading of dishwashers.

BACKGROUND

Methods for operating or controlling dishwashers are known from the state of the art. The aim of operating such dishwashers is typically to achieve a high degree of user-friendliness and at the same time the best possible result (in the case of a dishwasher, in particular, a cleaning result that is as flawless as possible).

One approach to achieve a high degree of user-friendliness would be, for example, to optimize the user interface (input devices, output devices). If, for example, increased soiling is to be considered, the user must take this into account manually, for example, and select an appropriate program. Approaches are also conceivable in which device parameters are automatically adjusted to achieve the best possible result. For example, in the case of a dishwasher, the program carried out by the dishwasher is adjusted, for example, to the amount of objects to be cleaned with which the dishwasher is loaded. Although this already makes it possible to improve the result, the user must actively select the appropriate program.

However, the disadvantage is that both the user-friendliness to be achieved in this way and the result to be achieved in this way in many situations and scenarios still need improvement.

BRIEF SUMMARY

Devices, computer programs, and methods for improving the operation of a dishwasher are provided. In an exemplary embodiment, a method includes acquiring a set of acceleration data with an acceleration sensor in a treatment chamber of the dishwasher. The set of acceleration data is indicative of a progression of measured acceleration values. A set of evaluation data is determined based at least in part on the set of acceleration data. Determining the evaluation data comprises determining whether one or more characteristic actions have been performed by a user, and if so action data representing the one or more characteristic actions are stored. The action data is a part of the set of evaluation data. A set of evaluation data is output.

A device for improving the operation of a dishwasher is provided in another embodiment. The device is configured to acquire a set of acceleration data with an acceleration sensor in a treatment chamber of a dishwasher, where the acceleration data is indicative of a progression of measured acceleration values. The device is further configured to determine a set of evaluation data based at least in part on the set of acceleration data. Determining the evaluation data comprises determining whether a characteristic action has been performed by a user, and the device is configured to make that determination. If the set of acceleration data includes the characteristic action performed by a user, action data representing the characteristic action is stored where that data is a part of the set of evaluation data. The device is also configured to output a set of evaluation data.

A computer program for improving the operation of a dishwasher is provided in yet another embodiment. The computer program includes program steps that cause a processor to execute or control process steps that improve the operation of a dishwasher. In particular, the computer program includes program steps that cause a set of acceleration data to be acquired by an acceleration sensor in a treatment chamber of a dishwasher, where the set of acceleration data is indicative of a progression of measured acceleration values. The computer program further includes instructions to determine a set of evaluation data based at least in part on the acceleration data, and determine whether the set of evaluation data includes a characteristic action performed by a user. The computer program then issues instructions to store action data representing the characteristic action, where the action data is a part of the set of evaluation data. The computer program also issues instructions to output a set of evaluation data.

BRIEF DESCRIPTION OF THE DRAWINGS

The present disclosure will hereinafter be described in conjunction with the following drawing figures, wherein like numerals denote like elements, and.

DETAILED DESCRIPTION

Figure 1:
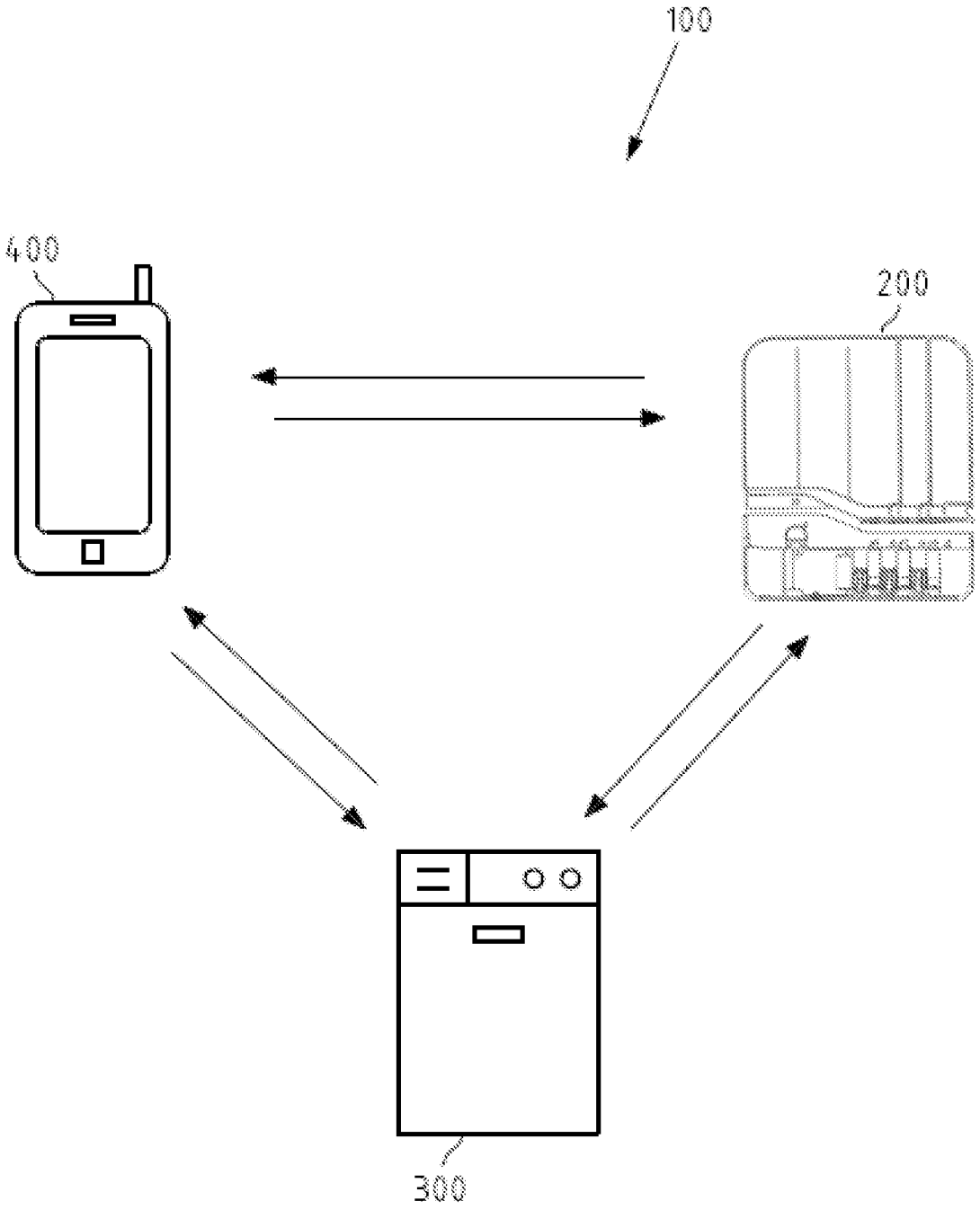
FIG. 1 shows a schematic representation of an embodiment of a system as contemplated herein.

The following detailed description is merely exemplary in nature and is not intended to limit the disclosure or the application and uses of the subject matter as described herein. Furthermore, there is no intention to be bound by any theory presented in the preceding background or the following detailed description.

Against this background, the present disclosure has the task of improving the result to be achieved with the dishwasher with the greatest possible user-friendliness.

The present disclosure concerns a method according to the subject-matter of the independent Claim 1. Further embodiments are described in the dependent claims.

According to a first exemplary aspect of the present disclosure, a method is disclosed which comprises the following:

acquiring at least one set of acceleration data indicative of a progression of measured acceleration values, wherein the at least one set of acceleration data is acquired by at least one acceleration sensor in a treatment chamber of a dishwasher;

determining at least one set of evaluation data at least partially based on the acquired acceleration data, wherein the determination comprises determining the set of evaluation data:

determining whether one or more characteristic actions have been performed by a user, and if so, performing the following:

storing a set of action data representing said one or more actions, which is included in or at least a part of said determined evaluation data; and outputting or causing the output of the determined evaluation data.

According to a second aspect of the present disclosure, a device is described which is configured or includes appropriate components to perform and/or control a method according to the first aspect. Devices of the method according to the first aspect are or comprise in particular one or more devices according to the second aspect.

Alternatively or additionally, the device according to the first and/or second aspect may further comprise one or more sensors and/or one or more communication interfaces.

A communication interface is to be understood, for example, as a wireless communication interface and/or a wired communication interface.

A wireless communication interface is, for example, a communication interface according to a wireless communication technology. An example of a wireless communication technology is a local radio network technology such as Radio Frequency Identification (RFID) and/or Near Field Communication (NFC) and/or Bluetooth (e.g. Bluetooth version 2.1 and/or 4.0) and/or Wireless Local Area Network (WLAN). RFID and NFC, for example, are specified according to ISO standards 18000, 11784/11785 and ISO/IEC standards 14443-A and 15693. WLAN, for example, is specified in the standards of the IEEE 802.11 family. Another example of a wireless communication technology is a supra-local radio network technology such as a mobile radio technology, for example Global System for Mobile Communications (GSM) and/or Universal Mobile Telecommunications System (UMTS) and/or Long Term Evolution (LTE). The GSM, UMTS and LTE specifications are maintained and developed by the 3rd Generation Partnership Project (3GPP).

A wired communication interface is, for example, a communication interface according to a wired communication technology. Examples of a wired communication technology are a Local Area Network (LAN) and/or a bus system, for example a Controller Area Network bus (CAN bus) and/or a Universal Serial Bus (USB). CAN bus, for example, is specified according to ISO standard ISO 11898. LAN, for example, is specified in the standards of the IEEE 802.3 family. It is understood that the output module and/or the sensor module may also include other components not listed.

According to the second aspect of the present disclosure, an alternative device is also described, comprising at least one processor and at least one memory containing computer program code, wherein the at least one memory and the computer program code are adapted to execute and/or control with the at least one processor at least one method according to the first aspect. A processor is to be understood, for example, as a control unit, a microprocessor, a microcontrol unit such as a micro-controller, a Digital Signal Processor (DSP), an Application-Specific Integrated Circuit (ASIC) or a Field Programmable Gate Array (FPGA).

An exemplary device, for example, further comprises features for storing data such as a program memory and/or a working memory. For example, an exemplary device as contemplated herein further comprises features for receiving and/or sending data via a network such as a network interface. Exemplary devices as contemplated herein are, for example, interconnected and/or connectable via one or more networks.

An exemplary device according to the second aspect is or comprises, for example, a data processing system which is configured in terms of software and/or hardware to be able to carry out the respective steps of an exemplary method according to the first aspect. Examples of data processing equipment are a computer, a desktop computer, a server, a thin client and/or a portable computer (mobile device), such as a laptop computer, a tablet computer, a wearable, a personal digital assistant or a smartphone.

Individual method steps of the method according to the first aspect may be performed with a sensor device, which also includes at least one sensor element or sensor(s). Likewise, individual method steps which, for example, do not necessarily have to be performed with the sensor device may be performed by a further device which is connected, in particular via a communication system, to the device which includes at least one sensor element or sensor(s).

Further devices may be envisaged, for example a server and/or, for example, a part or a component of a so-called computer cloud, which provide data processing resources dynamically for different users in a communication system. In particular, a computer cloud is understood to be a data processing infrastructure according to the definition of the "National Institute for Standards and Technology" (NIST) for the term "cloud computing". An example of a computer cloud is a Microsoft Windows Azure platform.

According to the second aspect of the present disclosure, a computer program is also described which comprises program instructions which cause a processor to execute and/or control a method according to the first aspect when the computer program is executed on the processor. An exemplary program as contemplated herein may be stored in or on a computer-readable storage medium containing one or more programs.

According to the second aspect of the present disclosure, a computer-readable storage medium containing a computer program according to the second aspect is also described. A computer-readable storage medium may, for example, be a magnetic, electrical, electro-magnetic, optical and/or other type of storage medium. Such a computer-readable storage medium is preferably physical (i.e. "touchable"), for example, it is designed as a data storage media device. Such data storage media device is for example portable or permanently installed in a device. Examples of such data storage media device are volatile or non-volatile memories with random access (RAM) like NOR flash memory or with sequential access like NAND flash memory and/or memory with read-only access (ROM) or read-write access. Computer-readable is to be understood, for example, as meaning that the storage medium may be read and/or written by a computer or a data processing system, for example by a processor.

According to a third aspect of the present disclosure, a system is also described comprising one or more devices which together perform a method according to the first aspect.

Exemplary features and exemplary embodiments according to all aspects are described in more detail below:

The progression of measured acceleration values is represented, for example, by a large number of measured acceleration values that were acquired over a predetermined period of time, whereby the respective absolute measured acceleration values are mapped to represent the progression over a time axis.

Dishwashers usually use a cleaning agent (e.g. so-called dishwasher tabs and/or rinse aid) to clean objects placed in the treatment chamber, such as cutlery, dishes, pans or pots, to name but a few non-limiting examples.

According to a design of the method according to the first aspect, the at least one device performing the method comprises the dishwasher and/or a separate device, in particular a mobile device (e.g. a dosing device), which may preferably be placed in the treatment chamber of the dishwasher.

For example, the device performing the method is or comprises the household device, i.e. in particular the dishwasher. If the dishwasher itself is trained for this purpose, the method may be performed with a small number of devices and in particular without an additional separate device of the user.

Alternatively, however, an additional and separate device to the dishwasher is provided. This has the advantage that the method may usually be performed independently of the type and properties of the dishwasher, which otherwise might not be possible or not to the same extent. The separate device is for example a mobile (portable) device. For example, the separate device is a mobile device that may optionally be in communication with the dishwasher (e.g. wireless network).

The separate device may, however, also be a mobile device which is placed in the dishwasher (e.g. during operation), i.e. in the example of a dishwasher it is placed in the interior or treatment chamber. Such a separate device is, for example, a dosing device that is designed to deliver a substance (especially a cleaning agent) to the dishwasher. Such separate device may be in communication with the dishwasher, a mobile device and/or a remote server (e.g. to exchange the acquired data (e.g. acceleration data)).

A casing surrounding the device is designed, for example, to be placed in the treatment chamber of the dishwasher and has, in particular, an appropriate size that allows the casing or device to be at least partially placed inside and/or removed from the treatment chamber. In particular, the casing or device may be placed in the treatment chamber loosely and/or without connecting components. For example, in the case of a dishwasher, the casing or device must be placed in and/or removed from, together with the objects to be cleaned, the treatment chamber. In particular, the casing of the device partially or completely encloses some or all of the device's components. In particular, the casing is designed to be watertight so that some or all of the device's cleaning agents do not come into contact with water when the device is placed in a treatment chamber, for example the dishwasher's treatment chamber, and especially during treatment.

The device or casing referred to in the second aspect is in particular a mobile and/or portable device and/or a device other than a dishwasher. A mobile and/or portable device is to be understood, for example, as a device whose external dimensions are smaller than about 30 cm×30 cm×30 cm, preferably smaller than about 15 cm×15 cm×15 cm. A device other than a dishwasher is, for example, a device that has no functional connection with the dishwasher and/or is not a part that is permanently connected to the dishwasher. For example, a device that is mobile and/or portable and different from the dishwasher is a device that is placed (e.g. inserted) in the dishwasher's treatment chamber by a user for the duration of a treatment process (e.g. cleaning program). An example of such a mobile and/or portable device as well as a device different from a dishwasher is a dosing device and/or sensor device, which is placed in the treatment chamber before the start of the cleaning program.

The casing may have at least one output module which is designed to dispense at least one preparation into the treatment chamber of the dishwasher and/or to trigger an output. The output of a preparation, for example, comprising cleaning agents, is to be understood, for example, as meaning that the preparation is output to the environment of the output module and/or a storage container for the preparation. The output is carried out, for example, by the output module. Alternatively or additionally, output may be affected by the output module, e.g. the output module causes the preparation to be output through the storage container. For example, the output module causes the preparation to be output through an output opening of the output module and/or the storage container to the environment of the output module and/or the storage container.

The casing also comprises, for example, at least one sensor module which is designed to determine at least one set of sensor data characteristic of the condition of the treatment chamber of the dishwasher. Such sensor data may, for example, be at least one parameter of a conductivity (for example of a substance in the treatment chamber such as water and/or a cleaning solution or liquor) and/or the temperature, for example of the temperature in the treatment chamber and/or the temperature of a substance in the treatment chamber such as water, and/or the brightness (for example whether light enters the treatment chamber of the dishwasher or not). Accordingly, the sensor module may comprise one or more sensors which are configured for the acquisition of characteristic sensor data, for example a conductivity sensor and/or a temperature sensor (for example a thermocouple). A sensor is also understood to be a mechanical sensor (e.g. a pressure sensor) and/or an optical sensor (e.g. a CCD sensor).

An acceleration sensor (or accelerometer) is a sensor that measures its acceleration. This is done, for example, by determining the inertial force acting on a mass of the acceleration sensor. Thus it may be determined, for example, whether there is an increase or decrease in speed. Such acceleration sensor may, for example, be included in at least one sensor module.

For example, an acceleration sensor may represent a motion sensor. Such a motion sensor may, for example, detect a change in position. A movement may, for example, be detected by employing an acceleration sensor in such a way that movements are calculated as an integration of detected data (e.g. measured values) from an acceleration sensor. For example, the dishwasher may determine the position of the device, for example in the treatment chamber.

The data acquired by the acceleration sensor represents, for example, an acceleration and/or movement of the device according to the second aspect, which comprises the at least one acceleration sensor. Furthermore, the data acquired by the acceleration sensor may, for example, represent a specific position and/or orientation of the at least one acceleration sensor inside the dishwasher.

The at least one acceleration sensor acquires the measured values representing the progression, for example at a predefined sampling frequency, e.g. from about 0.001 Hz to about 1 GHz, preferably from about 0.1 to about 25 MHz.

To operate the at least one acceleration sensor, a supply voltage of from about 1V-6V, preferably from about 2.5V-4.0V, is required with an energy source, depending on the type of acceleration sensor used. In particular, the acceleration sensor may be operated with a supply voltage of from about 1.9V to about 3.6V, so that self-sufficient use, e.g. with a battery as the energy source, is possible.

An acceleration sensor that also has a high temperature tolerance is particularly suitable. This is understood to mean in particular error-free operation of the acceleration sensor at high ambient temperatures (e.g. above from about 60° C.-65° C., from about 70° C.-75° C., from about 80° C.-85° C., from about 90° C.-95° C., or above).

Furthermore, such an acceleration sensor has, for example, a sensitivity (resolution) that is in the range of detectable accelerations of ±8 g, ±7 g, ±6 g, ±5 g, ±4 g, ±3 g, ±2 g, ±g or below. As contemplated herein, acceleration sensors with a detectable range of ±2, ±g or below are particularly suitable, in particular due to the sometimes small deflections or accelerations which are detected during the execution of the method according to the first aspect of the present disclosure.

For example, the at least one acceleration sensor has a resolution (also referred to as sensitivity) per LSB (Least Significant Bit) of from about 0.001 to about 1.0 milli g (gravities)/LSB, preferably of from about 0.05 to about 0.25 milli g/LSB.

The resolution of milli g per LSB represents a factor (sensitivity) with which unprocessed measured values acquired by the at least one acceleration sensor are multiplied to represent the resolution provided by the at least one acceleration sensor as a measured value. In this way, for example, acceleration data may be determined with the at least one acceleration sensor, which represents an acceleration of from 0 g to about 1000 g, preferably of from about 0.0001 g to about 16 g.

For example, a sensitivity (resolution) of the acceleration sensor may be achieved by using an analog-to-digital (A/D) converter, e.g. with a resolution of about 16, about 20, or about 24 bits, of about 0.06 milli g.

The at least one acceleration sensor has, for example, a sensitivity of from about 0.001 mg/LSB (Least Significant Bit) to about 1.0 mg/LSB, preferably of from about 0.05 mg/LSB to about 0.25 mg/LSB.

For example, the acceleration sensor is a MEMS (Micro Electro-Mechanical System) multi-axis acceleration sensor. Typically, such a MEMS sensor measures a change in capacitance when acceleration value changes.

The acceleration data determined by the acceleration sensor is, for example, at least partially indicative of a load status of the dishwasher. The acceleration data determined by the acceleration sensor represents, for example, whether the treatment chamber of the dishwasher is loaded or not or to what degree the treatment chamber of the dishwasher is loaded. Additionally or alternatively, the acceleration data determined by the acceleration sensor may also be characteristic of how full (e.g. as a percentage of the maximum possible capacity) the treatment chamber of the dishwasher is loaded (or filled). This may be determined when determining the evaluation data based on the acceleration data.

In determining the evaluation data, it is determined whether one or more characteristic actions have been performed by a user, and if so, an action data representing the one or more actions included in the determined evaluation data or at least part of the determined evaluation data is stored.

The acceleration data is evaluated, for example, by analyzing the progression of the acceleration values that are included or represented by the acceleration data, for example for the presence of characteristic patterns with which, for example, at least a section of the progression may be compared. In this way, the load status of the dishwasher may, for example, be inferred. Further configurations with regard to the load status of the dishwasher treatment chamber are explained in more detail below.

Afterwards, the output or initiation of the output of the specific evaluation data takes place. This may be carried out once, for example. Alternatively, this may be done by continuously entering at least one set of acceleration data and then determining the evaluation data (at least based on the part of the acceleration data that has been added and for which no evaluation data has yet been determined). For example, the evaluation data may be output or caused to be output several times. For example, the output may be sent to the dishwasher if the method is performed by a device separate from the dishwasher according to the first aspect of the present disclosure. Alternatively or additionally, the output or the initiation of the output may, for example, be performed to a device that is different from the dishwasher or the separate device, such as a server. The server may, for example, provide so-called cloud services, for example, such a server may determine control data for the device according to the second aspect of the present disclosure, just to name one non-limiting example.

In an embodiment according to all aspects of the present disclosure, the at least one set of acceleration data is acquired with respect to a predefined orientation and/or positioning of the at least one acceleration sensor in the treatment chamber of the dishwasher.

The orientation and/or positioning of the acceleration sensor inside the treatment chamber of the dishwasher are predefined. This is the case, for example, if the acceleration sensor does not change its orientation and/or positioning with respect to the treatment chamber of the dishwasher during the execution of the method according to the first aspect of the present disclosure. For example, the device may also include features for determining the orientation and/or positioning with respect to the dishwasher's treatment chamber. Alternatively, for example, the device according to the second aspect, which is configured to execute the method according to the first aspect, may comprise instructions (e.g. markings or the like, to give only one non-limiting example), so that, for example, a user may place the device according to the second aspect of the present disclosure in the treatment chamber of the dishwasher in such a way that the orientation and/or positioning of the at least one acceleration sensor with respect to the treatment chamber of the dishwasher is predefined.

In an embodiment according to all aspects of the present disclosure, the determination of the at least one set of evaluation data is performed while the acquisition of the at least one set of acceleration data continues.

Determining the at least one set of evaluation data, for example, is done while continuing to collect the at least one acceleration data. This means, for example, that for a predefined period of time, e.g. one minute, to name only one non-limiting example, measured values are first acquired by employing the at least one acceleration sensor, or alternatively or additionally the acquisition of acceleration data is started, if for example a characteristic action of the user has been performed, e.g. opening or closing the door closing the treatment chamber, to name only one non-limiting example. In addition, the determination of the evaluation data may be started or performed. At the same time, for example, the acquisition of measured values using the acceleration sensor is continued. This makes it possible, in particular, to successively monitor, for example, the loading or unloading of the treatment chamber of the dishwasher.

In an alternative embodiment according to all aspects of the present disclosure, the determination of the at least one evaluation data is performed separately from the acquisition of the at least one set of acceleration data.

In this alternative, both events do not take place simultaneously.

In an embodiment according to all aspects of the present disclosure, the method further comprises:

determining control data at least partially based on evaluation data, wherein the control data causes a dosing device (e.g. located in the treatment chamber of the dishwasher) to perform a dosing of cleaning and/or care agent defined according to the control data.

Based on the control data, the dosing device is controlled and/or regulated. The dosing device may, for example, be a self-contained or built-in dosing device. Furthermore, the dosing device may, for example, be a part of the device according to the second aspect of the present disclosure, or may be comprised by the device according to the second aspect of the present disclosure. In this case, the device according to the second aspect of the present disclosure and the metering device form a single entity. The dosing device is alternatively a device separate from the device according to the second aspect of the present disclosure.

The control data may also initiate or cause the operation or control of a dishwasher at least in respect of the specific evaluation data. Such operation or control may, for example, include selecting or changing a cleaning program of the dishwasher, changing one or more process parameters of a cleaning program carried out by the dishwasher and/or adding or omitting method sections.

According to a further embodiment of the method according to the first aspect, the control data also influences:

switching the dishwasher on and/or off;

selecting, combining and/or dosing a detergent to be used for the dishwasher; and/or a cleaning program of the dishwasher.

With regard to switching the dishwasher on and/or off, it may be influenced, for example, by whether the dishwasher is switched on and/or off (at all) and/or at what time (time, date) the dishwasher is switched on and/or off, just to name a few non-limiting examples.

Influencing the selection, composition and/or dosing of a detergent to be used for the dishwasher may be affected by different actions. For example, the quantity to be dosed (e.g. the quantity of detergent and/or rinse aid), the dosing time, the product to be dosed or individual ingredients or combinations thereof may be influenced. A dosing device and/or a dispensing module, which may be included in the device according to the second aspect of the present disclosure, may perform a corresponding dosing of the detergent.

The control data may, for example, cause a dispensing and/or triggering of the output of a preparation by an output module which is included in or connectable to the device according to the second aspect of the present disclosure. For example, the control data was determined in such a way that, for example, a lot of cutlery and/or dishes and/or pots were loaded in the treatment chamber of the dishwasher so that intensive cleaning may be carried out by a corresponding cleaning program of the dishwasher.

Influencing the cleaning program of the dishwasher may, for example, include selecting a certain (preprogrammed) program, running additional programs, influencing (lengthening or shortening) the program duration, or changing individual parameters of the program (e.g. temperature, drying time, to name but a few non-limiting examples).

In addition, it is possible not only to operate or control the operation of the dishwasher (automatically) based on the control data, but also to make a recommendation to the user. For example, in addition to an automated adjustment of the dishwasher, it may also be possible to display a recommendation to the user, e.g. by employing an output device of a user interface (e.g. included in the dishwasher). For example, the user may be informed that, for example, by storing used items in the treatment chamber of the dishwasher, they tend to develop bad odors, so that the user may decide to run a cleaning program. This may, for example, counteract the development of bad odors.

An embodiment according to all aspects of the present disclosure stipulates that the device according to the second aspect is designed to communicate with the dishwasher, in particular to communicate wirelessly with the dishwasher.

For example, communication with the dishwasher may be affected by employing a communication interface contained in the device according to the second aspect of the present disclosure. The communication interface is especially designed to communicate wirelessly with the dishwasher.

An embodiment according to all aspects of the present disclosure stipulates that one or more characteristic actions of the user are represented by one or more of the following actions i) to iv):

i) loading or unloading an object into or from the treatment chamber of the dishwasher;

ii) pulling out or sliding back a basket of the treatment chamber of the dishwasher;

iii) opening or closing a door closing the treatment chamber of the dishwasher;

iv) rinsing cycle of a cleaning program to be carried out by the dishwasher.

For example, actions (i) to (iv) are combined. For example, an object may be placed in the dishwasher's treatment chamber after a basket has been pulled out of the dishwasher. If the treatment chamber was not locked by the door, the user first performed action iii), and after the object was inserted, the user performed it again by closing the door.

Each of the actions i) to iv) may be determined at least partially based on the acceleration data in the context of determining the evaluation data, since each of the actions i) to iv) is represented by characteristic patterns in the acceleration data or the progression of the measured values represented by the acceleration data.

In a further embodiment according to all aspects of the present disclosure, the acceleration data is at least partially indicative of a movement of the at least one acceleration sensor with respect to its orientation and/or positioning in the treatment chamber of the dishwasher.

A movement of the at least one acceleration sensor is exemplified by a movement of the at least one acceleration sensor comprising one or more degrees of freedom, by a movement path, or a combination thereof. For example, a distance covered by the at least one acceleration sensor may be represented by the one or more degrees of freedom and/or the movement path. For example, the further the distance traveled, the more likely it is, for example, that a dishwasher basket has been slid back or pulled out (action ii) by the user.

In the event that a vibration has been detected as movement of the at least one acceleration sensor in the progression represented by the acceleration data, depending on the strength of the vibration and/or the duration of the fading of the vibration caused by the vibration, into which the at least one acceleration sensor has been set, e.g. action i) or iii) of the user may be present.

In the case where a slight but continuous vibration has been detected as a movement of the at least one acceleration sensor in the progression represented by the acceleration data, there may for example be action iv) where the user has, for example, caused the dishwasher to execute a cleaning program.

An embodiment according to all aspects of the present disclosure stipulates that the object which is placed in or removed from the treatment chamber of the dishwasher is at least a piece of cutlery or a piece of crockery.

Depending on the progression represented by the measured values of the acceleration data and/or the ratio of the amplitude and/or the ratio of the frequency of the change in the amplitudes of the measured values represented by the acceleration data, the evaluation data may be determined in such a way that it represents, for example, whether dishes, cutlery and/or pans or pots were placed in or removed from the treatment chamber of the dishwasher.

In an embodiment according to all aspects of the present disclosure, the method further comprises:

acquiring or obtaining one or more sets of sensor data, said one or more sets of sensor data being indicative of a temperature or a brightness (e.g. light intensity), wherein determination of the evaluation data is further based at least in part on said one or more sets of sensor data.

The actions i) to iv) are combined, for example, with sensor data representing a temperature and/or brightness or light intensity. In particular, the sensor data may be used to verify the evaluation data determined at least partially on the acceleration data. Temperature data, for example, which are represented by the sensor data, may be used to verify the rinsing cycle of a cleaning program that may be carried out by the dishwasher. Furthermore, brightness data represented by the sensor data may be used to verify the opening or closing of a door closing the treatment chamber of the dishwasher, to name but a few non-limiting examples.

At least one temperature sensor may be used to acquire sensor data indicative of a temperature. At least one brightness sensor or light intensity sensor may be used to detect sensor data indicative of brightness.

An embodiment according to all aspects of the present disclosure stipulates that the acceleration data and/or the one or more sets of sensor data are acquired over a predefined period of time.

The predefined period of time is indicative of a continuous or discrete acquisition of the acceleration data and/or one or more sets of sensor data. The predefined time span may, for example, be defined by a specific time period, e.g. for a period of a few minutes, up to several days or weeks, to name just a few non-limiting examples. Acquisition of the acceleration data and/or one or more sets of sensor data may trigger acquisition for a period of time to be determined or predetermined. For example, if the opening of the door of the dishwasher has been determined (action iii)), the acquisition of the acceleration data and/or the one or more sets of sensor data may be triggered for a period of from about 1 to about 10, from about 2 to about 8, from about 3 to about 7, from about 4 to about 6 or about 5 minutes, as it may be assumed, for example, that loading or unloading of objects takes place after the door has been opened. Similarly, closing the door may stop the acquisition of the acceleration data and/or the one or more sets of sensor data, for example, because it may be assumed that the user has completed the loading or unloading of objects. It is understood that other scenarios are possible according to the type of the above examples.

An embodiment according to all aspects of the present disclosure stipulates that the at least one acceleration sensor is placed inside the treatment chamber of the dishwasher, in particular on or in a lower basket for receiving objects to be cleaned, so that the predefined positioning of the at least one acceleration sensor is inside the treatment chamber of the dishwasher.

Accordingly, the acceleration data then detected represents a movement and/or acceleration of the at least one acceleration sensor with respect to the lower basket. If, for example, the acceleration data represents a strong vibration, the evaluation data may be determined taking into account that it is highly probable that a vibration has occurred in that basket of the dishwasher in or on which the at least one acceleration sensor is arranged. If, on the other hand, the vibration determined within the context of the evaluation data is less strong, the probability is high that objects have been placed in a basket that deviates from the basket in or on which the at least one acceleration sensor is placed.

The evaluation data is determined, for example, as a function of a predefined orientation and/or positioning of the at least one acceleration sensor.

By knowing the orientation, it is possible, for example, to analyze, within the context of determining the evaluation data, whether a basket of the dishwasher was slid back or pulled out, and/or whether objects were loaded into or removed from the treatment chamber (e.g. by taking into account the direction of movement of the first impulse with which the at least one acceleration sensor was set in motion, to name only one non-limiting example).

An embodiment according to all aspects of the present disclosure stipulates that the at least one set of acceleration data represents a signal in the direction of each of two or three degrees of freedom.

The at least one set of acceleration data is acquired by the at least one acceleration sensor, for example, in the direction of 2-axes (x-, y-axes) or 3-axes (x-, y-, z-axes) with respect to a Cartesian coordinate system. The respective axes are perpendicular to each other, so that two or three (all) spatial directions may be detected.

Furthermore, the acquired acceleration data may represent, for example, whether the acceleration is positive or negative.

An embodiment according to all aspects of the present disclosure stipulates that the determination of the evaluation data is carried out separately for all two or three degrees of freedom.

The respective measured values of the acceleration data (e.g. as measured signals) in one of the two or three directions of the acceleration data may, for example, be compared with each other in the course of determining the evaluation data. Alternatively or additionally, the evaluation data may be determined for each signal in one of the two or three degrees of freedom or in the corresponding direction.

If the at least one set of acceleration data represents a signal in the direction of each of three degrees of freedom, the individual measured values of each direction may, for example, be compared with each other. In this way, it is possible, for example, that at least one of the characteristic patterns, e.g. the characteristic pattern detected, which is represented by a set of acceleration data in one direction (e.g. x-direction, or along the x-axis of the coordinate system) is compared with a signal in a further direction (e.g. y-, or z-direction, or along the y-, or z-axis of the coordinate system) to verify the characteristic pattern detected in the course of determining the evaluation data.

For example, all results of the evaluation data may be compared with each other or among each other in the case that one set of evaluation data for each of the two or three degrees of freedom represents a movement and/or acceleration direction of the at least one acceleration sensor. In this way, for example, the results may be verified against each other. This enables, for example, the detection of measurement errors which may be detected by the verification and then, for example, not be taken into account when determining the evaluation data.

An embodiment according to all aspects of the present disclosure stipulates that the determined evaluation data is indicative of a rinsing cycle and/or loading or unloading of a basket or level inside the treatment chamber of the dishwasher, in which objects to be cleaned may be placed, and/or of a size of an object placed in or removed from a basket or level inside the treatment chamber of the dishwasher. The evaluation data is also indicative of a load condition of the treatment chamber of the dishwasher.

It is not only possible to determine, on the basis of the at least one set of acceleration data, whether (any) objects have been placed in or removed from the dishwasher's treatment chamber, but also to determine on the basis of the at least one set of acceleration data how, for example, the loading of objects has taken place. For example, loading and/or unloading with large objects may be distinguished from loading and/or unloading with smaller objects. Furthermore, it may be distinguished whether large or small objects have been loaded, for example, into an upper, middle and/or lower basket located in the treatment chamber of the dishwasher or a corresponding upper, middle and/or lower level.

Furthermore, it may be determined how many objects, optionally dedicated according to the size of the object (e.g. cutlery, small, medium, large pot, just to name a few non-limiting examples) and the position of pulling out or sliding back (e.g. basket or level) were loaded or unloaded. This may, for example, be determined on the basis of the intensity (amplitude, frequency, change in amplitude, or the like) of the measured values (or signals) represented by the at least one set of acceleration data on the respective axes (e.g. in the direction of one, two or three degrees of freedom) of the at least one acceleration sensor (within the scope of determining the evaluation data). For example, it may be determined which basket (level) has been moved. It may also be determined, for example, whether loading or unloading took place in the upper, middle and/or lower basket. In addition, it is therefore possible to determine whether the cutlery and/or crockery and/or cooking utensils (e.g. pots, pans, lids for pots and/or pans) have been loaded or unloaded, and also how many items have been loaded or unloaded. In addition, their size may also be determined.

An embodiment according to all aspects of the present disclosure stipulates that the determination of the evaluation data is further at least partially based on a nominal capacity of the treatment chamber of the dishwasher.

If the nominal capacity of the dishwasher is known (e.g. 13 standard place settings, or cubic meters of volume, to name only a few non-limiting examples), it may be determined at any time by determining the evaluation data, e.g. how full the dishwasher is loaded. This may be represented, for example, by an appropriately determined load data. The load data may be determined, for example, by determining the evaluation data. The load data may, for example, be included in the evaluation data that is then determined or at least part of the evaluation data representing the load data.

Based on the load data, a loading protocol may, for example, be generated that is indicative of the type and/or number of items in the individual baskets (or level, also called segments) that are currently or were previously positioned. The load data may, for example, be taken into account when determining the control data in such a way that the determination of the control data is further based on the load data. The control data determined in this way may then cause or be used, for example, by the dishwasher to dose a detergent or preparation depending on the actual load (i.e. type, number, quantity of items), to give one non-limiting example.

An embodiment according to all aspects of the present disclosure stipulates that the determination of the evaluation data further includes:

determining a time response of an oscillation at least partially based on the at least one set of acceleration data, the oscillation being represented by the progression of the measured acceleration values from the acceleration data, the time response being indicative of a size of an object placed in or removed from the treatment chamber of the dishwasher.

The progression of measured acceleration values, which are represented by the at least one set of acceleration data, is consequently characteristic for the time response of at least one oscillation, at least in parts or sections. It goes without saying, since the at least one set of acceleration data has been acquired over a predefined period of time, that different time periods represented by the measured values of the at least one set of acceleration data may represent different oscillations from one another (but sometimes also mutually superimposed).

An example is the unloading of objects from the treatment chamber of the dishwasher (e.g. represented by the characteristic action i) of the user). If, for example, the measured values of at least one set of acceleration data (e.g. resolution with about 100 Hz) have sufficient resolution, it may be determined that this signal measured by the acceleration sensor may be broken down into individual steps, i.e. individual pieces of crockery and cutlery. Each of these steps, i.e. one step corresponds, for example, to the unloading of exactly one object from the treatment chamber of the dishwasher, may be found as a freely attenuated oscillation in its complete dimensions in the progression of the acceleration data.

The size of a pot, for example, or the size of an object placed in or removed from the treatment chamber by a user may be determined via the respective freely attenuated oscillation, to name just one non-limiting example.

This is possible, for example, with objects in the form of pots and lids, to name only a few non-limiting examples, in such a way that the size of the pot or object may be deduced from the time response of the oscillation. For example, the longer the oscillation lasts, and the more it oscillates, the larger the object is with which the dishwasher's treatment chamber was loaded or unloaded. Furthermore, in the case of the special object(s) of a pot or pots, the duration and intensity of the oscillation correlates with the mass of the corresponding object. In this way the size of the loaded or unloaded object may be determined.

In a further exemplary embodiment according to all aspects of the present disclosure, the evaluation data is determined by employing an artificial neural network.

For example, the at least one set of acceleration data and optionally the one or more sets of sensor data may be communicated (e.g. transmitted) to a server which comprises or is connected to an artificial neural network. The determination of the evaluation data may then be performed, for example, by employing the artificial neural network. The result may then be communicated to the device according to the second aspect of the present disclosure and/or the dishwasher.

The artificial neural network may also be of the Generative Adversarial Network (GAN) type. Such a GAN comprises, for example, at least two artificial neural networks which compete against each other in such a way that their results are compared with each other. In this way, the quality of the result determined by the artificial neural network may be inferred. For example, a first artificial neural network of the GAN operates with data which it obtains, for example, from the current measurements (e.g. acquiring at least one set of acceleration data, and optionally acquiring at least one set of sensor data) and generates a statement (e.g. by employing a corresponding generator) about the result. In the present case, for example, the status data is determined. The second artificial neural network of the GAN (also called discriminator) may now compare this statement with an ideal, predetermined result or an ideal trained result. If the second artificial neural network determines no or only a small difference compared to the statement of the first artificial neural network, an optimal result is achieved. In this way, the determination of the status data by employing such a GAN artificial neural network may be significantly improved.

The artificial neural network includes, for example, an evaluation algorithm, so that, for example, training cases may be learned from as examples and these may then be generalized as a basis for determining a result (the evaluation data) after the learning phase has ended. This means that examples are not simply learned by heart, but patterns and regularities in the learning data are recognized. Different approaches may be followed for this purpose. For example, supervised learning, partially supervised learning, unsupervised learning, reinforced learning and/or active learning may be used. Supervised learning may, for example, be carried out using an artificial neural network (e.g. a recurrent neural network) or a support vector machine. Unsupervised learning may also be performed by employing an artificial neural network (e.g. an auto encoder). The learning data are, for example, acceleration data and optional sensor data received several times and/or the evaluation data determined after a run through the artificial neural network.

It is also possible to use the repeated acquisition of the acceleration data and the optional one or more sets of sensor data or the evaluation data for machine learning. For example, a user profile or one or more sets of data covered by the user profile may be determined at least partially based on machine learning.

By these measures the reliability of the monitoring of loading or unloading the treatment chamber of the dishwasher, and/or control and/or regulation of the device according to the second aspect of the present disclosure and/or the dishwasher and subsequently, in particular, the treatment of objects to be cleaned by the dishwasher, in particular, for the improved removal of soiling, may be increased.

Each of the training cases may, for example, be given by an input vector, a set of acceleration data and optionally one or more sets of sensor data and an output vector of the artificial neural network.

Each training case of the training cases may, for example, be generated by controlling and/or regulating the device associated with the training case according to the second aspect of the present disclosure and/or dishwasher, and determining the corresponding evaluation data to a predetermined status (e.g. defined quantity, type and position inside the treatment chamber of the dishwasher of one or more objects), and representative of acceleration data characteristic of the condition of the treatment chamber and optionally one or more sets of sensor data are acquired, and simultaneously, for example, a manual analysis of the condition of the treatment chamber of the dishwasher is carried out. The acceleration data then acquired and optionally the one or more sets of sensor data are determined, for example, as an input vector, and the (actual) condition of the dishwasher's treatment chamber is determined as an output vector of the training case as reference evaluation data. Then the evaluation data determined by the artificial neural network is transferred to that of the output vector. In this way, the artificial neural network may be trained iteratively or successively and the accuracy (e.g. hit rate) of the artificial neural network may be increased.

The exemplary embodiments of the present disclosure described above in this description should also be understood in all combinations with each other in a disclosed manner. In particular, exemplary embodiments should be understood in terms of the different aspects disclosed.

In particular, the previous or following description of method steps according to preferred embodiments of a method should also reveal corresponding features for carrying out the method steps by preferred embodiments of a device. Likewise, by the disclosure of a device for performing a method step, the corresponding method step shall also be disclosed.

Further advantageous exemplary embodiments of the present disclosure are shown in the following detailed description of some exemplary embodiments of the present disclosure, especially in connection with the Figures. The Figures, however, are only intended to clarify, but not to determine the scope of protection of the present disclosure. The Figures are not to scale and are merely intended to illustrate the general concept of the present disclosure. In particular, features included in the Figures are not intended to be considered as a necessary element of the present disclosure. The description of the Figures was described above, and is refreshed below.

Figure 2:
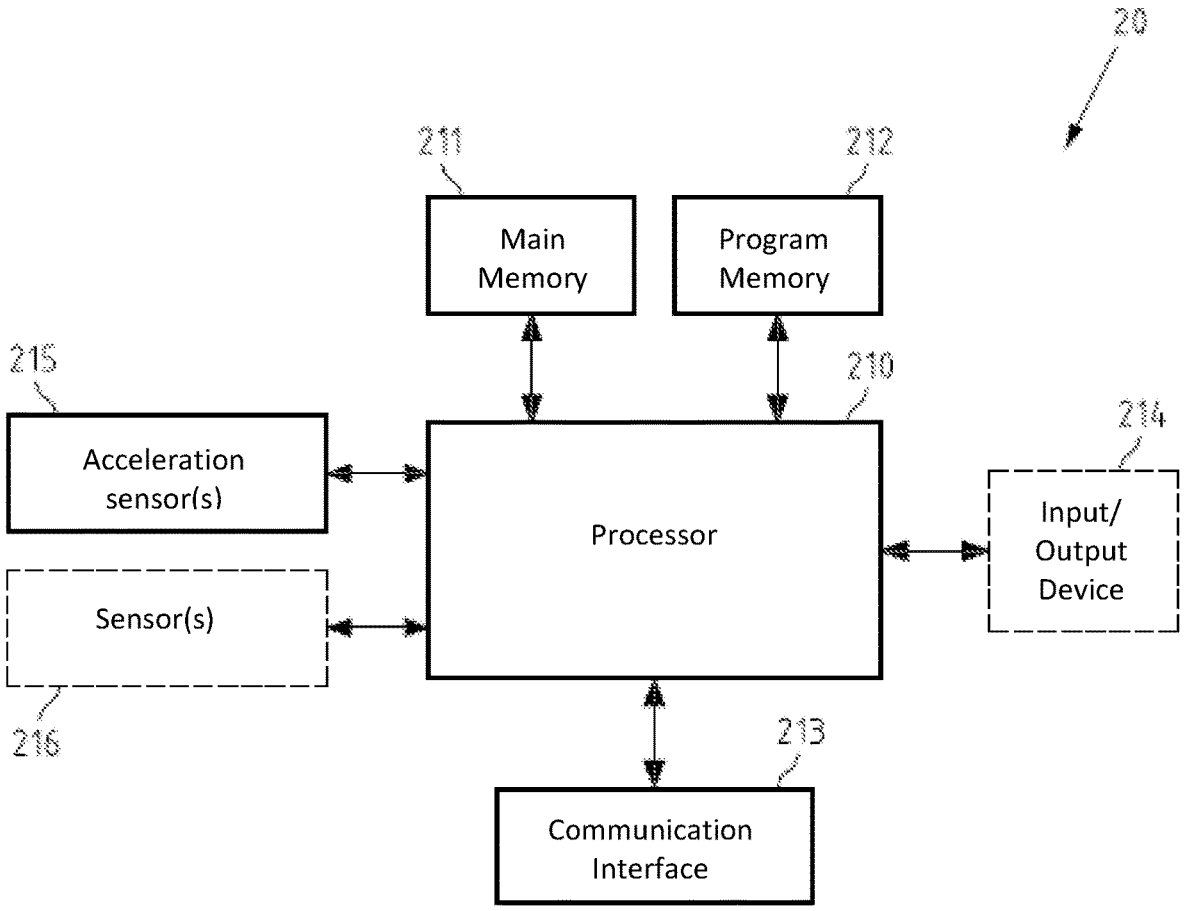
FIG. 2 shows a block diagram of an embodiment of a device for carrying out an embodiment of a method as contemplated herein.
Figure 3:
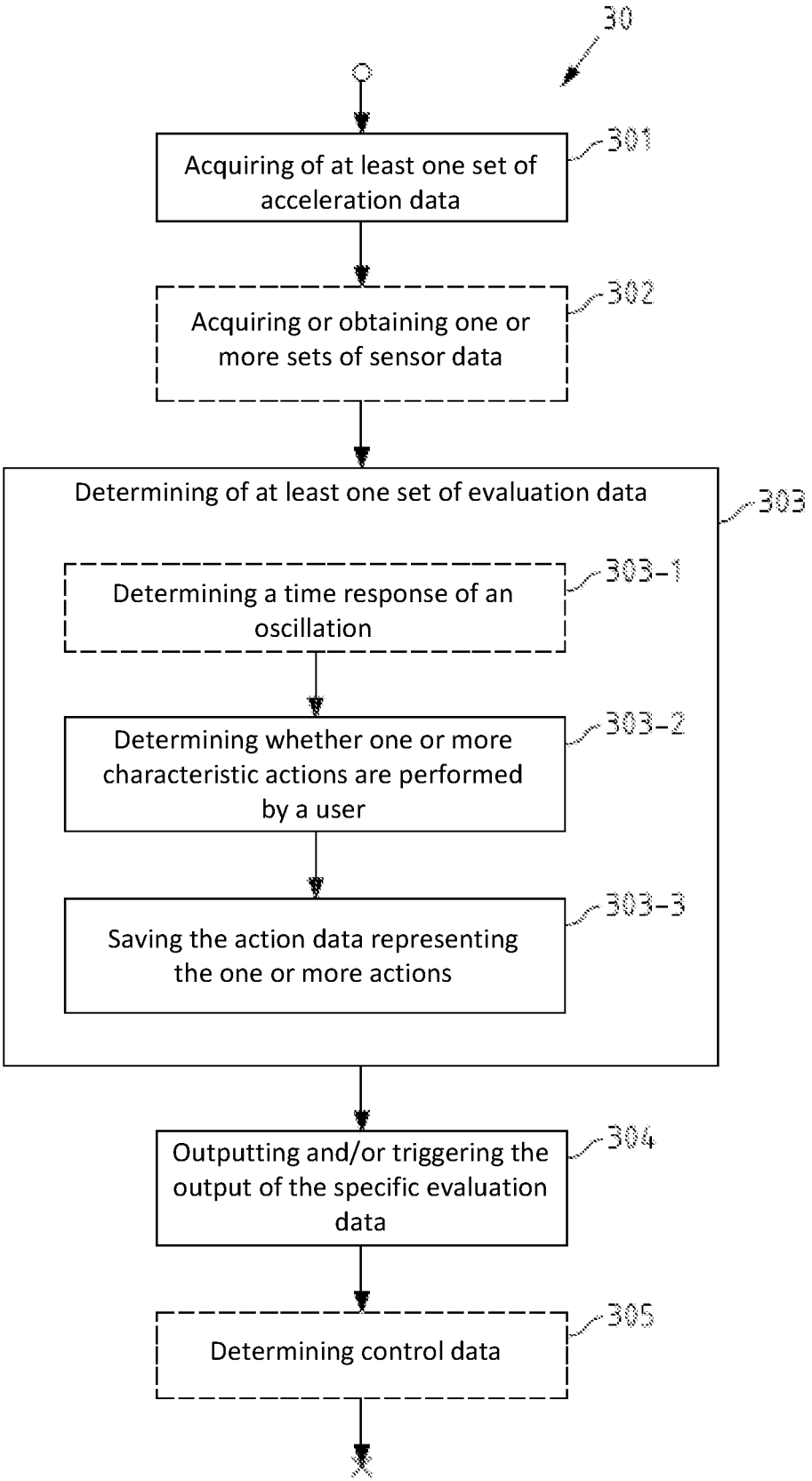
FIG. 3 shows a flow chart of an exemplary embodiment of a method as contemplated herein.
Figure 4:
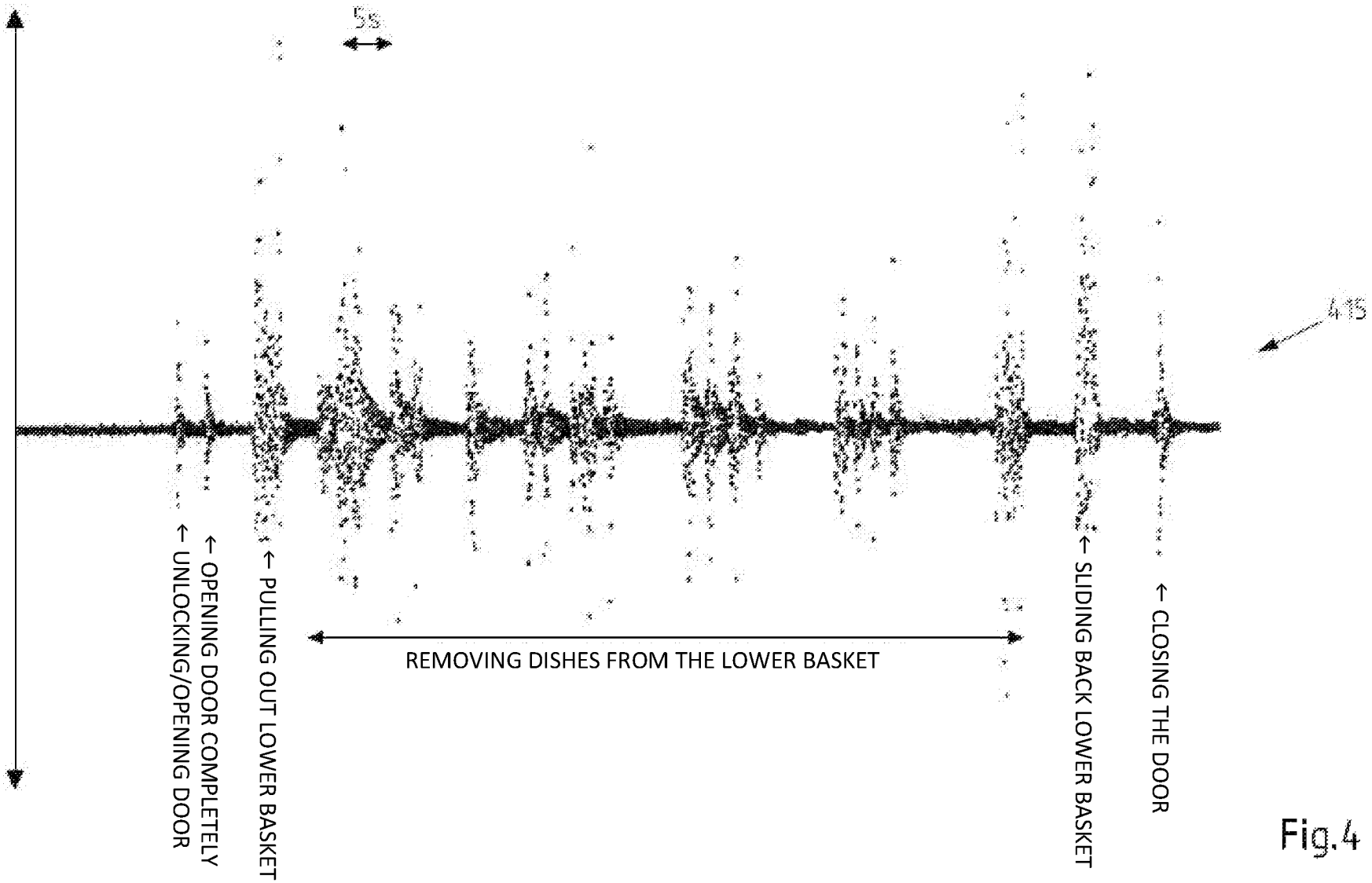
FIG. 4 shows a first exemplary progression of measured acceleration values represented by the displayed acceleration data (see also embodiment A)
Figure 5:
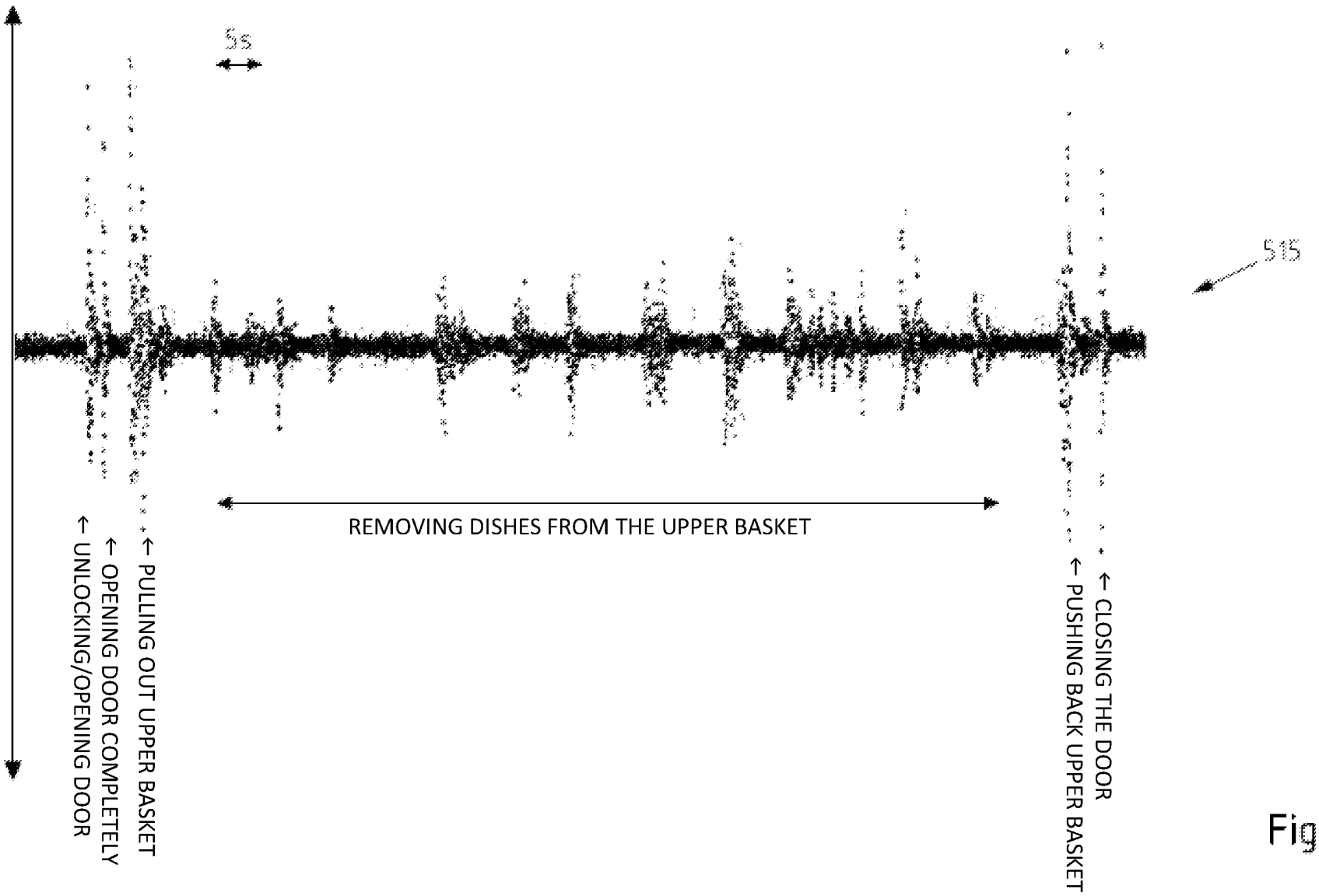
FIG. 5 shows a second exemplary progression of measured acceleration values represented by the displayed acceleration data (see also embodiment A)
Figure 6:
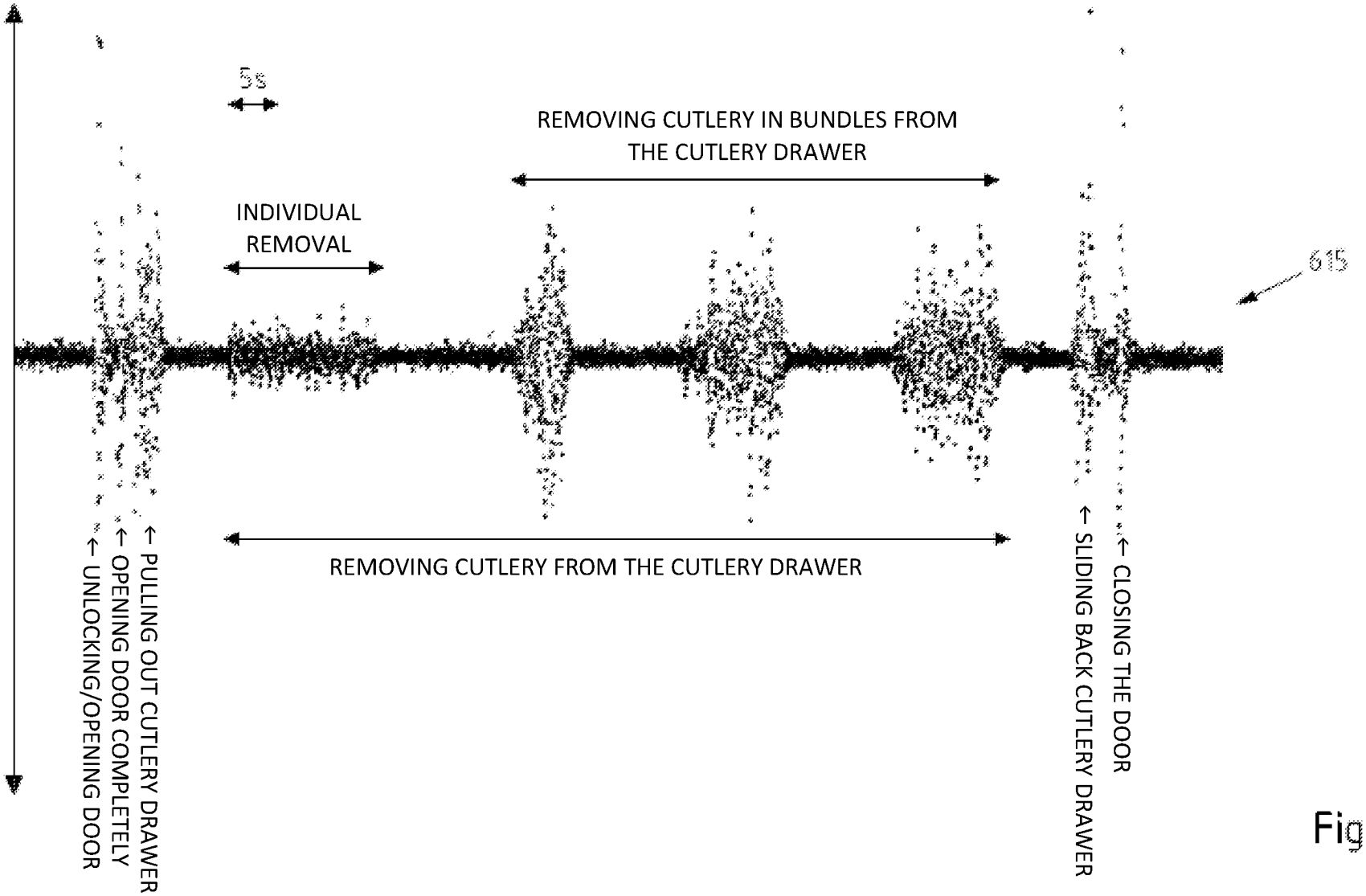
FIG. 6 shows a third exemplary progression of measured acceleration values represented by the displayed acceleration data (see also embodiment A)
Figure 7:
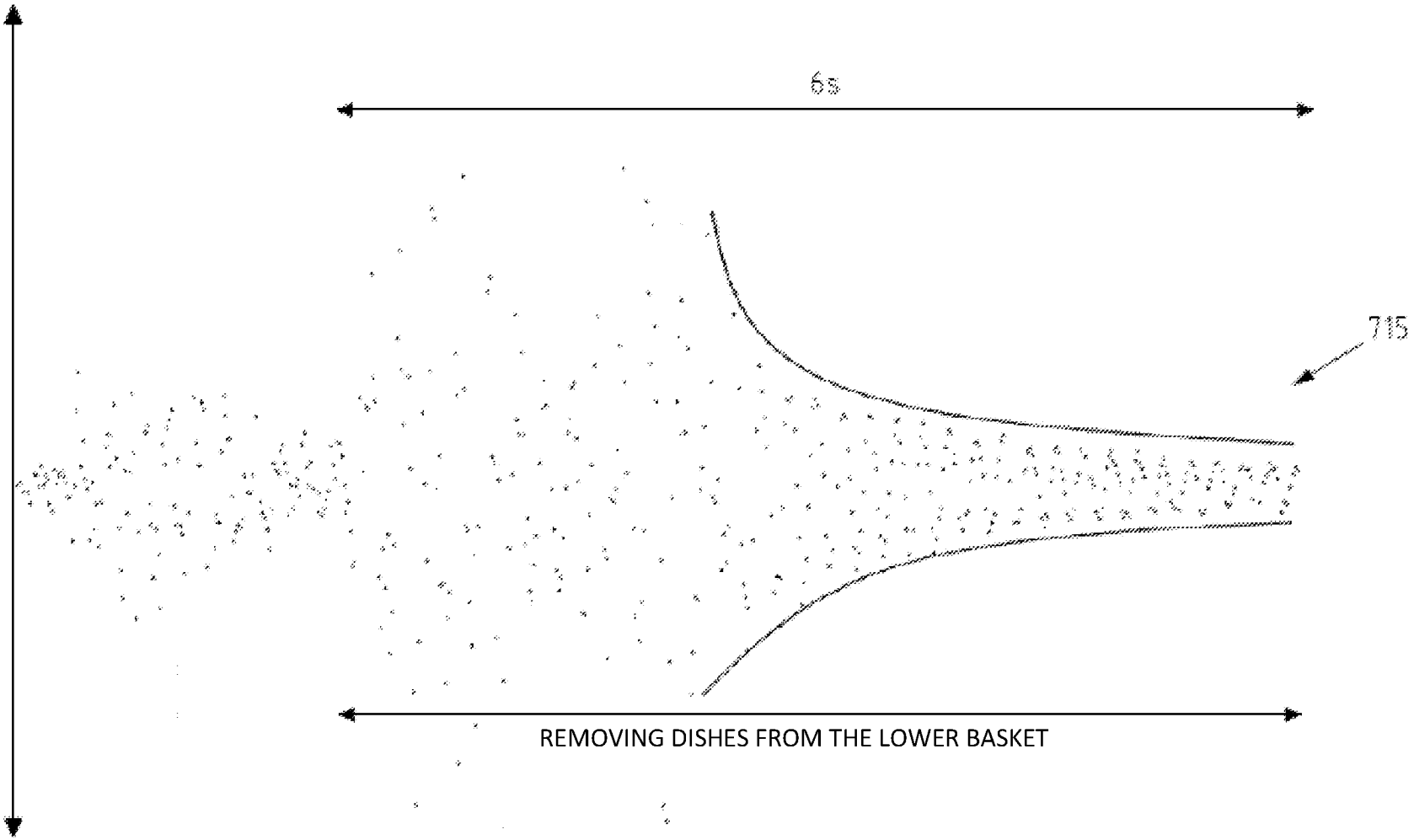
FIG. 7 shows a fourth exemplary progression of measured acceleration values represented by the displayed acceleration data (see also embodiment A)
Figure 8:
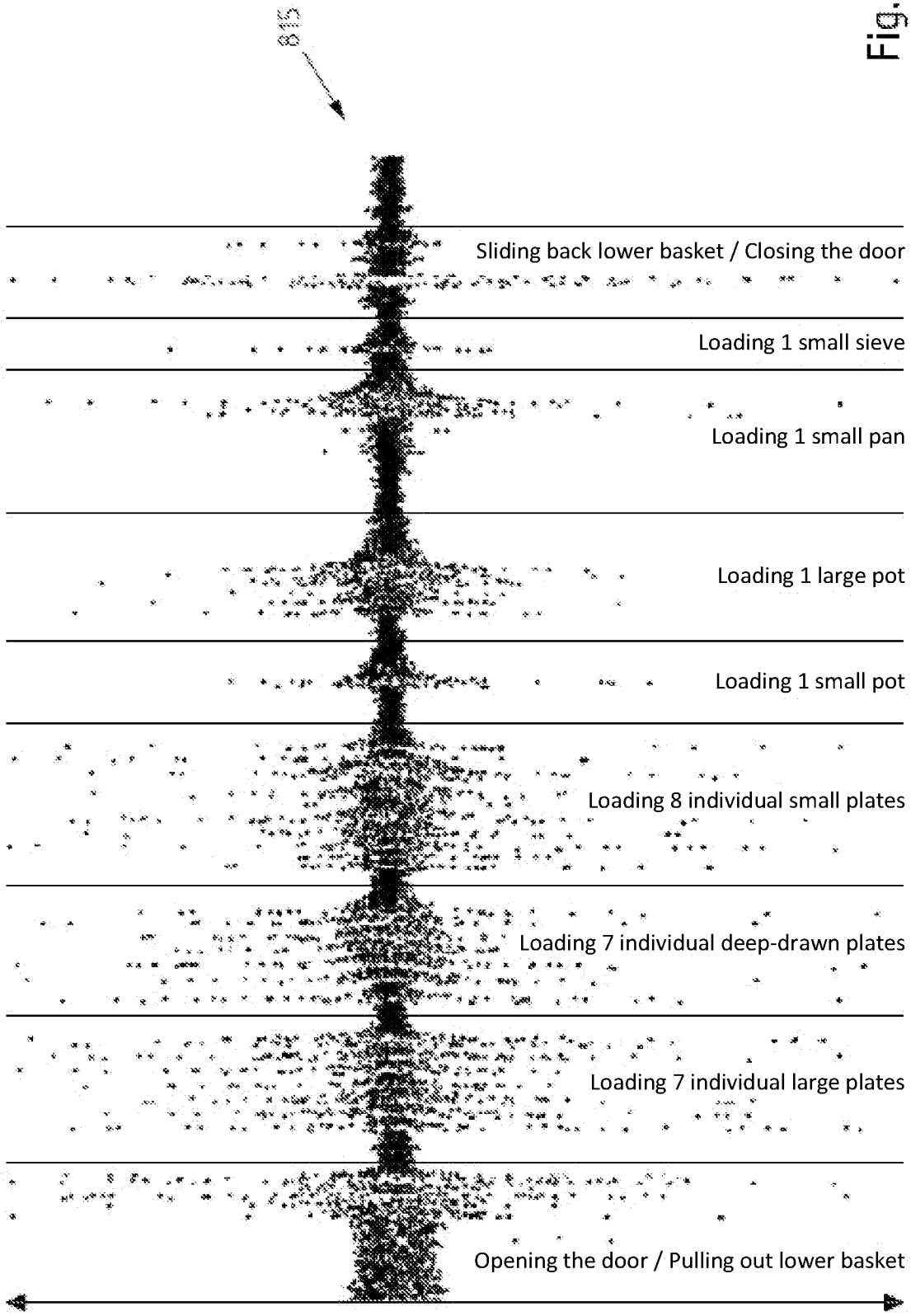
FIG. 8 shows a fifth exemplary progression of measured acceleration values represented by the displayed acceleration data (see also embodiment B)
Figure 9:
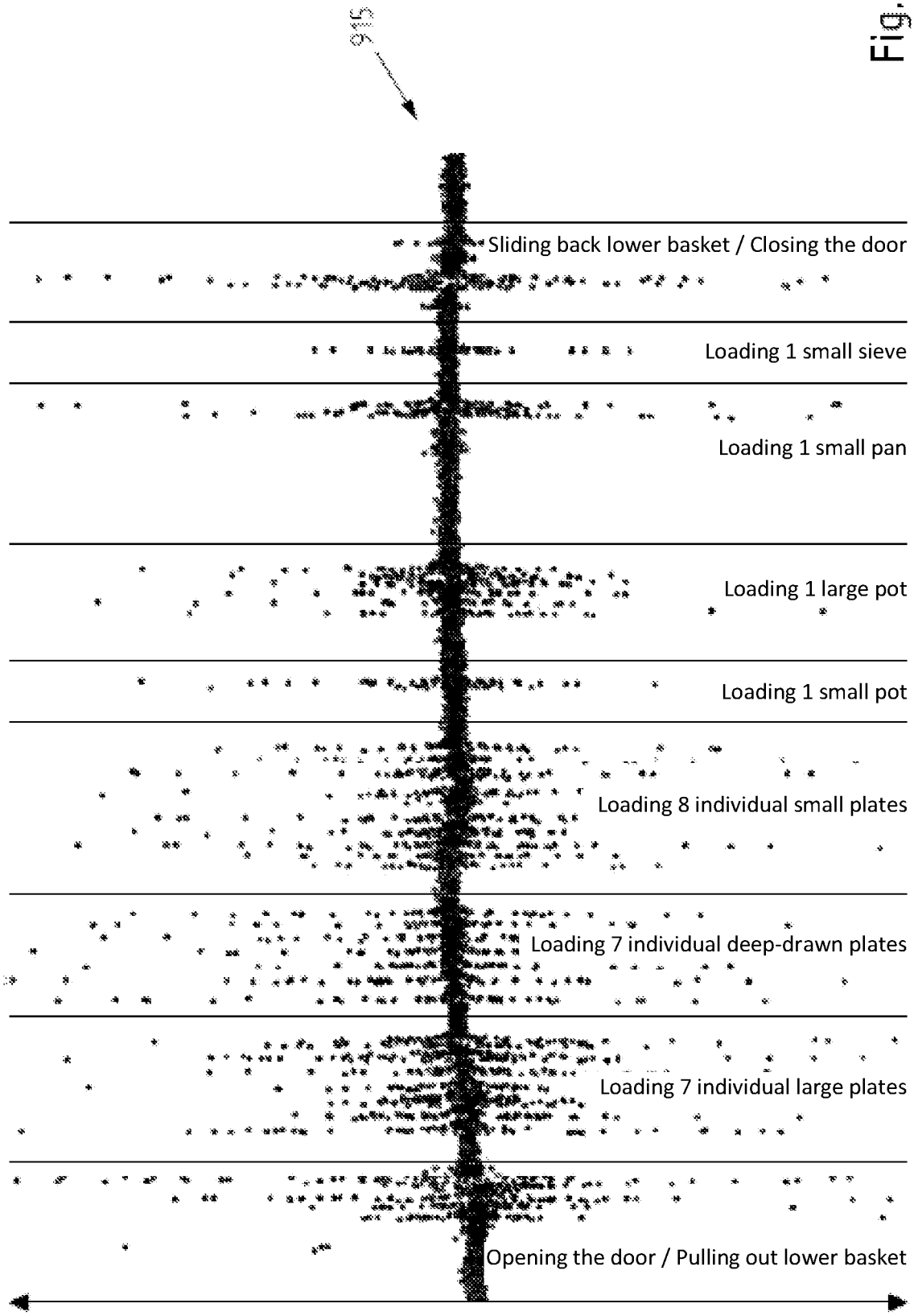
FIG. 9 shows a sixth exemplary progression of measured acceleration values represented by the displayed acceleration data (see also embodiment B)
Figure 10:
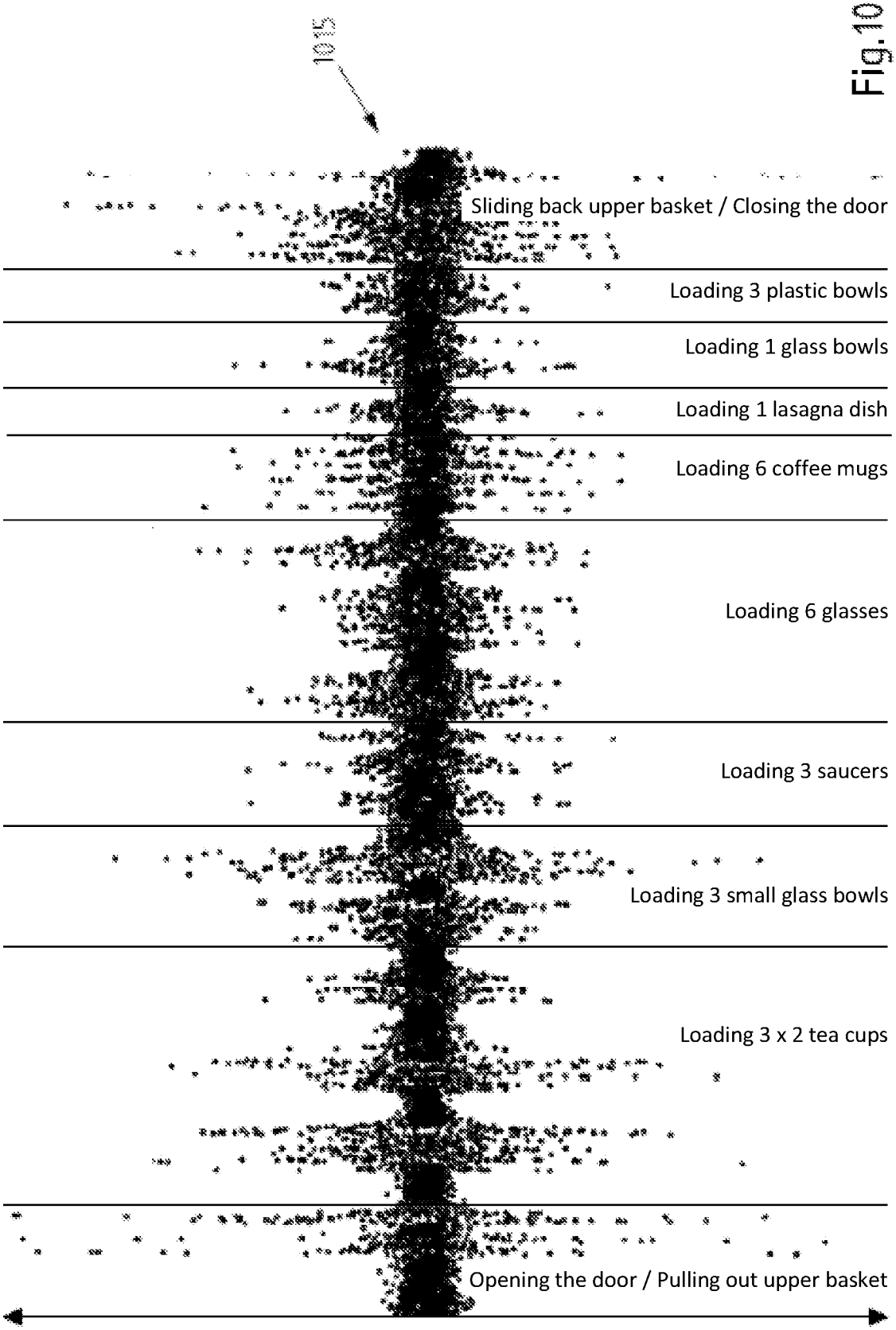
FIG. 10 shows a seventh exemplary progression of measured acceleration values represented by the displayed acceleration data (see also embodiment B)
Figure 11:
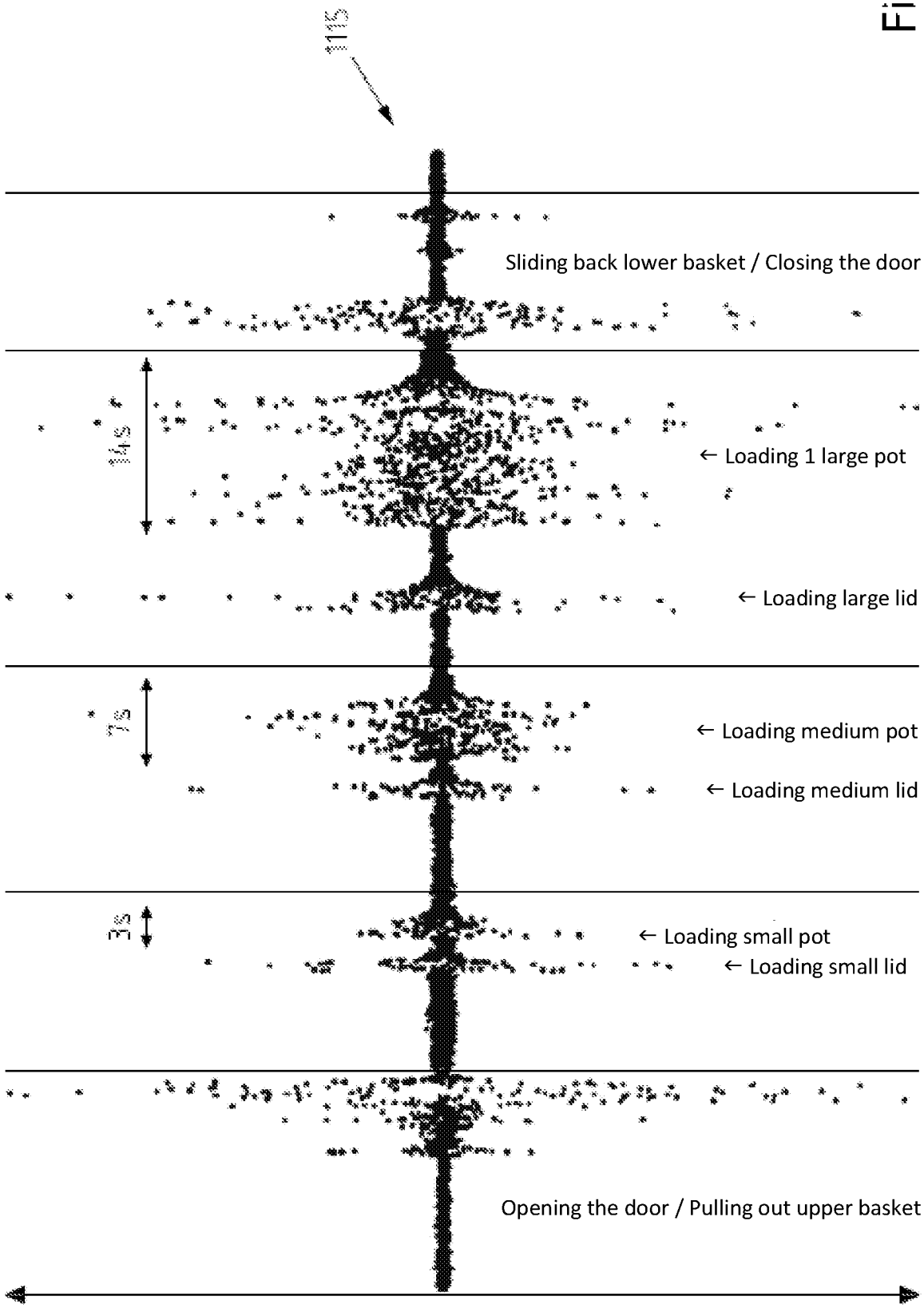
FIG. 11 shows an eighth exemplary progression of measured acceleration values represented by the displayed acceleration data (see also embodiment C).

FIG. 1 shows a schematic representation of an embodiment of a system as contemplated herein;

FIG. 2 shows a block diagram of an embodiment of a device as contemplated herein for carrying out an embodiment of a method as contemplated herein;

FIG. 3 shows a flow chart of an exemplary embodiment of a method as contemplated herein;

FIG. 4 shows a first exemplary progression of measured acceleration values represented by the displayed acceleration data (see also embodiment A);

FIG. 5 shows a second exemplary progression of measured acceleration values represented by the displayed acceleration data (see also embodiment A);

FIG. 6 shows a third exemplary progression of measured acceleration values represented by the displayed acceleration data (see also embodiment A);

FIG. 7 shows a fourth exemplary progression of measured acceleration values represented by the displayed acceleration data (see also embodiment A);

FIG. 8 shows a fifth exemplary progression of measured acceleration values represented by the displayed acceleration data (see also embodiment B);

FIG. 9 shows a sixth exemplary progression of measured acceleration values represented by the displayed acceleration data (see also embodiment B);

FIG. 10 shows a seventh exemplary progression of measured acceleration values represented by the displayed acceleration data (see also embodiment B); and FIG. 11 shows an eighth exemplary progression of measured acceleration values represented by the displayed acceleration data (see also embodiment C).

FIG. 1 first shows a schematic representation of an exemplary embodiment of System 100 as contemplated herein, comprising devices 200, 300 and 400. System 100 is configured to execute exemplary methods as contemplated herein. Device 200 is an exemplary mobile device 200, which in this case may be placed in the treatment chamber of the dishwasher 300. Both the device 200 and the dishwasher 300 may each be a device as contemplated herein. Furthermore, System 100 comprises as a further device a mobile device 400 in the form of a smartphone. Mobile device 400 may also perform individual steps of exemplary methods as contemplated herein. However, device 400 may also be a computer, a desktop computer or a portable computer, such as a laptop computer, a tablet computer, a Personal Digital Assistant (PDA) or a wearable. In addition or alternatively to devices 300 and 400, the system may also include a server (not shown). It is also conceivable that System 100 also includes fewer or more than three devices.

Each of the devices 200, 300, 400 may feature a communication interface in order to communicate with one or more of the other devices or to transfer and/or to exchange data from one device to another.

FIG. 3 shows a flowchart 30 of an exemplary embodiment of a method according to the first aspect of the present disclosure. Flowchart 30 may, for example, be executed by device 200 according to FIG. 1. Flowchart 30 may, for example, be executed by device 300 as shown in FIG. 1. Flowchart 30 may, for example, be executed both by device 200 according to FIG. 1 and by device 300 according to FIG. 1 together. Flowchart 30 may, for example, be executed by devices 200, 300 and 400 together as shown in FIG. 1.

In a first step 301, at least one set of acceleration data is acquired. Acquisition takes place, for example, by employing an acceleration sensor (e.g. acceleration sensor(s) 215 according to FIG. 2), which is integrated in device 200 or 300 according to FIG. 1. The acceleration sensor is situated in the treatment chamber of the dishwasher 300 during detection. In the event that device 200 according to FIG. 1 includes the acceleration sensor, it is thus at least temporarily located inside the treatment chamber of the dishwasher 300 during the acquisition.

In an optional second step, one or more sets of sensor data are acquired or received. The one or more sets of sensor data are, for example, acquired by a temperature and/or brightness sensor (e.g. sensor(s) 216 according to FIG. 2). In the event that the one or more sets of sensor data are received, they are first acquired by device 200 and/or 300 according to FIG. 1 and then transmitted to another device, e.g. device 400 according to FIG. 1, e.g. by employing a communication interface. In the latter case, the following step 303 is carried out by device 400 according to FIG. 1.

In a third step 303 at least one set of evaluation data is determined. Within the context of this step 303, optionally determination of a time response of an oscillation 303-1 may be performed based on the at least one set of acceleration data acquired in step 301. Within the context of step 303, it is determined whether one or more characteristic actions were performed by a user (step 303-2). In step 303, action data representing one or more actions of step 303-2 is stored (step 303-3). All steps included in step 303 may be executed by one of the devices 200, 300, and 400 according to FIG. 1. Alternatively, at least one of all the steps 303, 303-1, 303-2, and 303-3 may be performed by a different device that does not perform the remaining steps 303, 303-1, 303-2, and 303-3.

In a fourth step 304, the evaluation data determined in step 303 is output or initiated. For example, the evaluation data is output to a device 200, 300 or 400 according to FIG. 1. If the evaluation data is output to dishwasher 300, then dishwasher 300 may, for example, clean objects based on the evaluation data, to name just one example. If the evaluation data is output to device 400 according to FIG. 1 (e.g. mobile device of a user), the user of device 400 may monitor loading or unloading of the dishwasher 300 with his mobile device 400.

In an optional fifth step 305, control data is determined based on the evaluation data or on the evaluation data output. This specific control data may then be output. If the evaluation data was output to device 400 according to FIG. 1, or was determined by device 400 according to FIG. 1, this device 400 may also perform step 305. Afterwards, the specific control data may be output, for example, from device 400 to device 200 and/or 300 according to FIG. 1, so that device 200 and/or 300 according to FIG. 1 may trigger an action corresponding to the control data, e.g. carrying out dosing or starting a cleaning program, to name just a few non-limiting examples.

The step of acquiring acceleration data 301 and/or step 302 of acquiring or receiving one or more sets of sensor data may be performed simultaneously with step 303. This means, for example, that after an initial execution of step 301 and optionally of step 302, step 303 of determining the evaluation data is performed, while step 301 and optionally step 302 are further executed with the acquisition of further acceleration data (step 301) and optionally further sensor data (step 302).

FIG. 2 now shows a block diagram 20 of an exemplary embodiment of a device according to the second aspect of the present disclosure for performing an exemplary embodiment of a method according to the first aspect of the present disclosure. Block diagram 20 according to FIG. 2 may be used as an example for device 200 shown in FIG. 1, dishwasher 300 shown or the mobile device 400 (or part of it) shown.

Processor 210 of device 20 is designed in particular as a microprocessor, micro-controller unit, micro-controller, Digital Signal Processor (DSP), Application-Specific Integrated Circuit (ASIC) or Field Programmable Gate Array (FPGA).

Processor 210 executes program instructions stored in program memory 212 and stores, for example, intermediate results or the like in the working or main memory 211. Program memory 212 is, for example, a non-volatile memory such as a flash memory, a magnetic memory, an EEPROM memory (Electrically Erasable Programmable Read-Only Memory) and/or an optical memory. Main memory 211 is, for example, a volatile or non-volatile memory, in particular a Random Access Memory (RAM) such as a Static RAM memory (SRAM), a Dynamic RAM memory (DRAM), a Ferroelectric RAM memory (FeRAM) and/or a Magnetic RAM memory (MRAM).

Program memory 212 is preferably a local data storage medium firmly connected to device 20. Data storage media permanently connected to device 20 is, for example, hard disks which are built into device 20. Alternatively, the data storage medium may, for example, also be a data storage medium that is detachably connectable to device 20.

Program memory 212 contains, for example, the operating system of device 20, which is at least partially loaded into main memory 211 when the device 20 is started and is executed by processor 210. In particular, when device 20 is started, at least part of the core of the operating system is loaded into main memory 211 and executed by processor 210.

In particular, the operating system allows the use of device 20 for data processing. For example, it manages resources such as main memory 211 and program memory 212, communication interface 213, optional input and output device 214, provides basic functions to other programs through programming interfaces and controls the execution of programs.

Processor 210 further controls communication interface 213, which may, for example, be a network interface and may be designed as a network card, network module and/or modem. Communication interface 213 is configured in particular to establish a connection of device 20 (e.g. at least one of the devices 200, 300, and/or 400 according to FIG. 1) with other devices, in particular via a (wireless) communication system, for example a network, and to communicate with them. Communication interface 213 may, for example, receive data (via the communication system) and forward it to processor 210 and/or receive data from processor 210 and send it (via the communication system). Examples of a communication system are a local area network (LAN), a wide area network (WAN), a wireless network (e.g. according to the IEEE 802.11 standard, the Bluetooth (LE) standard and/or the NFC standard), a wired network, a mobile network, a telephone network and/or the Internet. For example, communication is possible with the Internet and/or other devices using the communication interface 213. In the case of devices 200, 300, 400 according to FIG. 1, communication interface 213 may be used to communicate with the other devices 200, 300, 400 or the Internet.

Via such communication interface 213, one or more sets of optional sensor data (cf. step 302 according to FIG. 3) and/or evaluation data (cf. step 303 or 304 according to FIG. 3) may be received or output to another device.

Furthermore, processor 210 may control at least one optional input/output device 213. Input/output device 213 is, for example, a keyboard, a mouse, a display unit, a microphone, a touch-sensitive display unit, a loudspeaker, a reader, a drive and/or a camera. For example, input/output device 213 may receive input from a user and forward it to processor 210 and/or receive and output data for the user from processor 210.

Finally, device 20 may comprise further components 215, 216.

Acceleration sensor(s) 215 may, for example, acquire one or more sets of acceleration data (cf. step 301 in FIG. 3).

Sensor(s) 216 are, for example, a temperature sensor to acquire temperature data and/or a brightness sensor to acquire brightness data. Both the temperature data and the brightness data may be represented by one or more sets of sensor data (cf. step 302 in FIG. 3).

The exemplary embodiments listed below should also be understood as disclosed:

The listed exemplary embodiments are capable of identifying loading and unloading processes in automatic dishwashers and differentiating them from washing processes.

It is advantageous to determine how often a user loads a dishwasher (e.g. dishwasher 300 according to FIG. 1) with dishes and cutlery before turning it on.

It is advantageous to determine into which baskets of a dishwasher the user loads dishes and cutlery.

It is also advantageous to determine what type of dishes the user is loading the dishwasher with.

It is also advantageous to determine when the user loads which type of crockery or cutlery into the dishwasher.

It is advantageous to determine when and how the user unloads the dishwasher.

It is advantageous to create a handling instruction for a dosing unit (e.g. device 200 according to FIG. 1) based on the type of load.

It is advantageous to create and communicate a loading protocol.

These advantages may, for example, be achieved by using an acceleration sensor in the interior (treatment chamber) of a household or commercial dishwasher (generally referred to as a dishwasher for the purposes of this description). An acceleration sensor, e.g. mounted on an electronic board of a self-contained dosing unit, is able to fully detect and interpret the vibrations, shocks and mechanical events that take place independently and with a time delay from a dishwashing process. In combination with other sensors, such as a temperature sensor or a brightness sensor, the processes may be clearly described. The acquired data may be used for machine learning applications, e.g. for pattern analysis, which is then converted into algorithms for controlling a dosing unit.

Exemplary Embodiment A

In a dishwasher, for example, a self-sufficient, automatic measuring and dosing device (e.g. device 200 according to FIG. 1) is placed according to the second aspect of the present disclosure, comprising at least one acceleration sensor, e.g. in the lower basket between dishes. The dishwasher, for example, is fully loaded and has completed a rinse cycle. A user empties the dishwasher in a subsequent work step. Surprisingly, the dishwasher unloading process carried out by the user may now be evaluated, as shown by the series of measurements carried out according to FIGS. 4 to 7.

FIG. 4 shows a first exemplary progression of measured acceleration values represented by acceleration data 415. Within the context of determining the evaluation data, various actions (of the user) may be determined in acceleration data 415, in this case unlocking or opening a door, opening the door completely (fully opened), pulling out a lower basket, removing dishes from the lower basket, sliding back the lower basket and closing the door.

FIG. 5 shows a second exemplary progression of measured acceleration values represented by the acceleration data 515. In the context of determining the evaluation data, various actions (of the user) may be determined in the acceleration data 515, in this case unlocking or opening a door, opening the door completely, pulling out a top basket, removing dishes from the top basket, sliding back the top basket and closing the door.

FIG. 6 shows a third exemplary progression of measured acceleration values represented by the displayed acceleration data 615. Within the context of determining the evaluation data, various actions (of the user) may be determined in the acceleration data 615, in this case unlocking or opening a door, opening the door completely, pulling out a cutlery drawer, removing cutlery, whereby a clear distinction can be made between removing cutlery individually and removing cutlery in bundles, sliding back the cutlery drawer, and closing the door.

FIG. 7 shows a fourth exemplary progression of measured acceleration values represented by the displayed acceleration data 715. Within the context of determining the evaluation data, various actions (of the user) may be determined in acceleration data 715, in this case a removal of dishes from the lower basket. The fading away of a freely attenuated oscillation, which was excited by the removal of dishes, is represented schematically by the amplitude envelope curves.

As can be seen from FIGS. 4 to 7, the following actions of a user may, for example, be determined based on at least one set of acceleration data acquired in accordance with a method according to the first aspect of the present disclosure:

- All mechanical processes during opening and closing and loading and unloading must be clearly distinguished from the background noise of the acceleration sensor in rest position.
- All mechanical processes during opening and closing and loading and unloading must be clearly distinguished from a current rinsing process.
- Opening the door must be clearly identified. It is a combination of unlocking, opening and keeping the door open.
- Pulling out the individual baskets must be clearly identified. The intensity of the signal (oscillation) may be used to determine which basket (lower basket, upper basket (also referred to as middle basket), optional cutlery drawer (also referred to as upper basket)) is being moved.
- Removal of individual items of crockery and cutlery is visible and may be displayed at all basket levels.
- Sliding back the baskets and closing the door may be clearly identified.

Essential is the insight that the processes surrounding unloading may be identified, but for the dosing unit it is particularly important to note that no rinsing activity starts, but the dishwasher is loaded.

Furthermore, the signal behavior in the lower basket differs from that of other baskets arranged in the treatment chamber of the dishwasher. Since the measuring and dosing device including the acceleration sensor is also located in the lower basket in the present case, so that its positioning and/or orientation is clearly defined inside the dishwasher treatment chamber, the sensitivity to mechanical processes is increased once again. On closer inspection of the unloading processes, these are to be described as freely attenuated oscillations, especially in the vicinity of the measuring and dosing device.

The unloading process may be broken down into individual steps, i.e. individual pieces of crockery and cutlery, if the signal (or measured value, represented by the at least one set of acceleration data) measured by the acceleration sensor has a good sensitivity (resolution presently about 100 Hz). Each individual process may be described in its complete dimension with the mathematics of a free attenuated oscillation. In FIG. 7, for example, the amplitude envelope is shown as the outer limit. The successive amplitudes can be clearly seen in the fading curve. This allows a mathematical description of the processes according to known rules of vibration theory in all parameters (e.g. decay coefficient, amplitude ratio, decay time, attenuation, attenuation constant, just to name a few non-limiting examples).

Without being bound to a theory, by evaluating these parameters over a large number of data sets, e.g. with the help of an (artificial) neural network, it is even possible to determine the nature of the tableware, e.g. steel, porcelain, plastic or glass.

In contrast to the dishwashing process, which in most cases may be described as a continuous process carried out by the user, the loading takes place discontinuously in short time segments before a new rinse cycle of the dishwasher. The loading period may be as long as desired, but is usually a period of 1 to 3 days (e.g. due to developing odorous substances from used cutlery and dishes stored inside the dishwasher's treatment chamber). Often only individual pieces of crockery, such as pots, are placed in the dishwasher.

Exemplary Embodiment B

Exemplary embodiment B shows exemplary loading processes and their metrological acquisition using an acceleration sensor.

In a dishwasher, for example, a self-sufficient, automatic measuring and dosing device is placed according to the second aspect of the present disclosure, comprising at least one acceleration sensor, e.g. in the lower basket between dishes. The dishwasher is, for example, empty.

A user places various tableware items in the dishwasher in a subsequent work step. Surprisingly, based on at least one set of acceleration data determined by an acceleration sensor included in the dosing device, all individual steps of the loading of the treatment chamber of the dishwasher performed by the user may be identified. FIGS. 8 and 9 show examples of the acceleration data determined.

FIG. 8 shows a fifth exemplary progression of measured acceleration values represented by acceleration data 815. Within the context of determining the evaluation data, various actions (of the user) may be determined in acceleration data 815, in this case opening the door (door open) and pulling out a lower basket, loading seven individual and large plates in the basket, loading seven individual deep-drawn plates in the basket, loading eight individual and small plates, loading a small pot, loading a large pot, loading a small pan, loading a small strainer, and subsequently sliding back the lower basket and closing the door.

FIG. 9 shows a sixth exemplary progression of measured acceleration values represented by the displayed acceleration data 915, whereas the acceleration data 915 of FIG. 9 represents that of FIG. 8, whereby acceleration data 915 was acquired with a higher resolution in contrast to acceleration data 815.

FIG. 8 shows the complete loading process of a sub-basket arranged inside the treatment chamber of the dishwasher on the y-axis of the acceleration sensor. The x-axis and z-axis (see FIG. 9) show a comparable picture.

Surprisingly, it is not only possible to observe the individual steps, but also to break down the individual steps, such as the loading of large plates, into sub-steps, i.e. to count, for example, how many objects are or were loaded into the dishwasher. If the nominal capacity of the dishwashers (e.g. 13 standard place settings) is known, it may be determined at any time how full the dishwasher is loaded. This is valuable data which may be used, for example, to control a self-sufficient or built-in dosing device, provided that the amount of waste correlates with the load quantity.

Just as during unloading, loading a dishwasher top basket located inside the treatment chamber may be observed. Surprisingly, the above also applies to the upper basket. The intensity of the signals on the respective axes of the acceleration sensor may be used to determine which basket (level) is being moved. It is also possible to determine which dishes are placed in the upper basket and also how many dishes are placed in it. In the example shown in FIG. 10, the signal evaluation on the y-axis of the sensor can be seen. The x-axis and z-axis show a comparable picture. Nevertheless, it may be advantageous to evaluate the signal (represented by at least one set of acceleration data) on all axes, especially if the actual number of dishes is to be determined, because the resolution of the signals on the axes may be of varying accuracy.

Exemplary Embodiment C

In a dishwasher, for example, a self-sufficient automatic measuring and metering device according to the second aspect of the present disclosure, comprising at least one acceleration sensor, is placed, for example, in the lower basket between dishes. The dishwasher is, for example, empty.

FIG. 10 shows a seventh exemplary progression of measured acceleration values represented by the depicted acceleration data 1015. Within the context of determining the evaluation data, various actions (of the user) may be determined in acceleration data 1015, in the present case opening the door (door open) and pulling out the upper basket, loading two tea cups three times in succession, loading three small glass bowls, loading three saucers, loading six glasses, loading six coffee mugs, loading one lasagna bowl, loading one glass bowl, loading three plastic bowls, as well as finally sliding back the upper basket and closing the door.

FIG. 11 shows an eighth exemplary progression of measured acceleration values represented by acceleration data 1115. Within the context of determining the evaluation data, various actions (of the user) may be determined in acceleration data 1115, in this case opening the door (door open) and pulling out the lower basket, loading a small lid and then loading a small pot, loading a medium-size lid and then loading a medium-size pot, loading a large pot, and finally sliding back the lower basket and closing the door.

In a subsequent step, the user places various pots with matching lids in the lower basket of the dishwasher. Surprisingly, the acceleration data acquired by an acceleration sensor makes it possible to observe the individual steps of the loading process and to recognize the pots according to their size. FIG. 11 shows loading the lower basket with three different pots, which differ significantly in size.

Small pot: diameter 16 cm; weight 0.47 kg;
Medium pot: diameter 20 cm; weight 1.0 kg;
Large pot: diameter 24 cm; weight 1.8 kg.

FIG. 11 schematically shows determined acceleration data from an acceleration sensor. Individual sections of the determined acceleration data may be characteristic for loading the dishwasher. In FIG. 9, for example, it can be clearly seen how objects are placed in the basket of the dishwasher treatment chamber. For example, a surprising effect may be added to pots and lids: the time response of the oscillation may be used to determine the size of the pot or the object. The longer the oscillation lasts and the more strongly it oscillates, the larger the object is with which the dishwasher's treatment chamber was loaded. Furthermore, for the specific object(s) of (a) pot(s), the duration and intensity of the oscillation correlate with the mass of the corresponding pot(s).

The data on the size of the loaded object may now be translated into handling instructions for the associated dosing device. For example, from the presence of many large objects, a dosing mode or cleaning cycle may be activated which is advantageous for the cleaning of these objects, e.g. an increase in detergent and/or rinse aid dosing, to name just one non-limiting example.

All in all, the creation of a loading protocol with e.g. the type and number of items in the individual segments of the dishwasher may be used to match the quantity of detergent and/or rinse aid to be dosed (e.g. detergent and rinse aid) to the number of items to be cleaned with the aim of achieving an optimum result in terms of performance and chemical use. The method as contemplated herein may be used with all known dishwashers—i.e. both with dishwashers used in (private) households and with commercial dishwashers, e.g. continuously operating dishwashers, which may be controlled and/or regulated e.g. based on the method according to the first aspect of the present disclosure—so that it is possible to achieve an optimum use of cleaning and/or care agent irrespective of the size of the dishwasher.

The method according to all aspects of the present disclosure may, for example, be carried out continuously, so that, for example, one or more sets of acceleration data (e.g. as corresponding data) are continuously acquired by employing the acceleration sensor and subsequently (successively) evaluated. In principle, one or more of the following aspects apply to all aspects of the present disclosure:

- all data may be stored locally and decentralized;
- all data may be subjected to additional data analysis;
- all data may be edited with a machine learning tool;
- conclusions about user behavior may be drawn from the data;
- user profiles may be created from the data; and
- from the results of the data analysis and/or machine learning, algorithms (instructions for action) for the operation of a self-sufficient dosing unit and a dishwasher may be derived.

The exemplary embodiments of the present disclosure described in this specification and the optional features and properties mentioned in each case should also be understood as disclosed in all combinations. In particular, unless explicitly stated otherwise, the description of a feature included in an example of an embodiment shall not be understood in the present case to mean that the feature is indispensable or essential for the function of the example. The sequence of the method steps described in this specification in the individual flowcharts is not mandatory; alternative sequences of the method steps are conceivable. The method steps can be implemented in various ways, for example, implementation in software (through program instructions), hardware or a combination of both to implement the method steps is conceivable.

Terms used in the Claims such as "comprising", "having", "including", "containing" and the like do not exclude further elements or steps. The expression "at least partially" covers both the "partially" case and the "completely" case. The wording "and/or" should be understood to mean that both the alternative and the combination should be disclosed, i.e. "A and/or B" means "(A) or (B) or (A and B)". The use of the indefinite article does not exclude a plural. A single device may perform the functions of several units or devices mentioned in the Claims. Reference marks indicated in the Claims should not be regarded as limitations of the features and steps used.

The invention claimed is:

1. A method, comprising the steps of:

acquiring at least one set of acceleration data indicative of a progression of measured acceleration values, wherein the at least one set of acceleration data is acquired by at least one acceleration sensor in a treatment chamber of a dishwasher;

determining at least one set of evaluation data based at least in part on the acquired at least one set of acceleration data, wherein determining the at least one set of evaluation data comprises:

determining whether one or more characteristic actions have been performed by a user, and if so, performing the following:

storing action data representing the one or more characteristic actions that are included in the determined at least one set of evaluation data or that are at least a part of the determined at least one set of evaluation data;

outputting or causing the output of the determined at least one set of evaluation data; and determining control data at least partially based on the at least one set of evaluation data, wherein the control data causes a dosing device to perform a dosing of cleaning and/or care agent defined according to the control data.

2. The method according to claim 1, wherein the at least one set of acceleration data is acquired with respect to a predefined orientation and/or placing of the at least one acceleration sensor in the treatment chamber of the dishwasher.

3. The method according to claim 2, further comprising:

placing the at least one acceleration sensor inside the treatment chamber of the dishwasher, so that the predefined positioning and/or orientation of the at least one acceleration sensor inside the treatment chamber of the dishwasher is present.

4. The method according to claim 1, wherein determining the at least one set of evaluation data is performed while the acquisition of the at least one set of acceleration data is continued.

5. The method according to claim 1, wherein the one or more characteristic actions of the user are represented by one or more of the following actions i) to iv):

i) loading or unloading an object into or from the treatment chamber of the dishwasher;

ii) pulling out or sliding back a basket of the treatment chamber of the dishwasher;

iii) opening or closing a door closing the treatment chamber of the dishwasher;

(iv) rinsing cycle of a cleaning program to be carried out by the dishwasher.

6. The method according to claim 5, whereby the object which is placed in or removed from the treatment chamber of the dishwasher is at least a piece of cutlery or crockery.

7. The method according to claim 1, further comprising:

acquiring or obtaining one or more sets of sensor data, said one or more sets of sensor data being indicative of a temperature or brightness inside the treatment chamber of the dishwasher, wherein determining the at least one set of evaluation data is further based at least in part on said one or more sets of sensor data.

8. The method according to claim 7, wherein the at least one set of acceleration data and/or the one or more sets of sensor data are acquired over a predefined period of time.

9. The method according to claim 1, wherein the at least one set of acceleration data represents a signal in the direction of each of two or three degrees of freedom.

10. The method according to claim 9, wherein the determination of the at least one set of evaluation data is performed separately for each of the two or three degrees of freedom.

11. The method according to claim 10, wherein determining the at least one set of evaluation data is further at least partially based on a nominal capacity of the treatment chamber of the dishwasher.

12. The method according to claim 1, wherein the determined at least one set of evaluation data is indicative of a rinsing cycle and/or a loading or unloading of an object placed inside the treatment chamber of the dishwashers and/or a size of an object placed in or removed from a basket placed inside the treatment chamber of the dishwasher, so that the at least one set of evaluation data is further indicative of a load condition of the treatment chamber of the dishwasher.

13. The method according to claim 1, wherein determining the at least one set of evaluation data further comprises:

determining a time response of an oscillation at least partially based on the at least one set of acceleration data, the oscillation being represented by the progression of the measured acceleration values from the at least one set of acceleration data, the time response being indicative of a size of an object placed in or removed from the treatment chamber of the dishwasher.

14. A device configured to execute and/or control the method according to claim 1.

15. The device according to claim 14, wherein the device is configured to place the at least one acceleration sensor in a predefined orientation in the treatment chamber of the dishwasher.

16. The device according to claim 15, wherein the at least one acceleration sensor is configured to measure acceleration in each of at least 2 degrees of freedom.

17. The device according to claim 14, wherein the device is configured to determine the one or more characteristic actions performed by the user, wherein the one or more characteristic actions comprise one or more of the following actions i) to iv):

i) loading or unloading an object into or from the treatment chamber of the dishwasher;

ii) pulling out or sliding back a basket of the treatment chamber of the dishwasher;

iii) opening or closing a door closing the treatment chamber of the dishwasher; and (iv) rinsing cycle of a cleaning program to be carried out by the dishwasher.

18. The device according to claim 14, wherein the device is further configured to acquire one or more sets of sensor data, said one or more sets of sensor data being indicative of a temperature or brightness inside the treatment chamber of the dishwasher, wherein determining the at least one set of evaluation data is further based at least in part on said one or more sets of sensor data.

19. A computer program comprising program instructions which cause a processor to execute and/or control the method according to claim 1 when the computer program is executed on the processor.

20. A device configured to:

acquire at least one set of acceleration data indicative of a progression of measured acceleration values, wherein the at least one set of acceleration data is acquired by at least one acceleration sensor in a treatment chamber of a dishwasher;

determine at least one set of evaluation data based at least in part on the acquired at least one set of acceleration data; and output or cause the output of the determined at least one set of evaluation data, wherein:

the at least one acceleration sensor is placed in a predefined orientation in the treatment chamber of the dishwasher and is configured to measure acceleration in each of at least 2 degrees of freedom, and the at least one set of evaluation data is determined by:

determining whether one or more characteristic actions have been performed by a user, and if so, performing the following:

storing action data representing the one or more characteristic actions that are included in the determined at least one set of evaluation data or that are at least a part of the determined at least one set of evaluation data.

* * * * *